US005649787A

United States Patent [19]

Hirose et al.

[11] Patent Number: 5,649,787

[45] Date of Patent: Jul. 22, 1997

[54] PIER UNIT AND FLOATING PIER INCLUDING SUCH A PIER

[75] Inventors: Koji Hirose; Takeshi Yamamoto, both of Yamatokoriyama; Toru Fujii, Kyoto, all of Japan

[73] Assignee: Nitta Corporation Nara Factory, Yamatokoriyama, Japan

[21] Appl. No.: 559,471

[22] Filed: Nov. 15, 1995

[30] Foreign Application Priority Data

| | | | |
|---|---|---|---|
| Nov. 18, 1994 | [JP] | Japan | 6-285357 |
| Nov. 30, 1994 | [JP] | Japan | 6-297355 |
| Dec. 28, 1994 | [JP] | Japan | 6-328023 |
| Mar. 16, 1995 | [JP] | Japan | 7-057802 |

[51] Int. Cl.[6] ..... E02B 3/20

[52] U.S. Cl. ..... 405/219; 114/266; 114/267; 405/218

[58] Field of Search ..... 405/218–221; 114/266, 267

[56] References Cited

U.S. PATENT DOCUMENTS

| | | | |
|---|---|---|---|
| 3,009,326 | 11/1961 | Williams | 405/220 X |
| 4,126,006 | 11/1978 | Lewis | 405/221 X |
| 4,604,962 | 8/1986 | Guibault | 114/266 |
| 4,940,021 | 7/1990 | Rytand | 405/219 X |
| 5,199,371 | 4/1993 | Meriwether | 405/219 X |

FOREIGN PATENT DOCUMENTS

| | | | |
|---|---|---|---|
| 1563144 | 3/1969 | France | 405/219 |

*Primary Examiner*—Dennis L. Taylor
*Attorney, Agent, or Firm*—Snell & Wilmer

[57] ABSTRACT

A pier unit includes a float having substantially a box shape with an opening at the top and including a flange extending outward along a top peripheral edge thereof; a rectangular frame attached to the float; a deck provided on the frame; and a connecting member secured to at least one of four corners of the frame for connecting the pier unit to another pier unit.

8 Claims, 23 Drawing Sheets

PIER UNIT AND FLOATING PIER INCLUDING SUCH A PIER

BACKGROUND OF THE INVENTION

1. Field of the Invention

The present invention relates to a floating pier to which a ship or a boat, for example, is anchored and which includes a plurality of pier units formed of a synthetic resin connected to each other. The present invention also relates to such a pier unit.

2. Description of the Related Art

A conventional floating pier 800 will be described with reference to FIGS. 31A and 31B. FIG. 31A is a top view of the floating pier 800, and FIG. 31B is a side view thereof in the direction of arrow M.

As is shown in FIGS. 31A and 31B, the floating pier includes a necessary number of pier units 80 connected to each other in series. Each of the pier units 80 has a length of approximately 10 meters and a width of approximately 2 meters. Each pier unit has connection parts 81 and 82 at two ends thereof in a longitudinal direction. Two pier units 80 are connected to each other by connecting the connection part 81 of one pier unit 80 and the connection part 82 of the other pier unit 80 by a pin 83.

Such a pier unit 80 is difficult to be mechanically produced by a molding apparatus due to the excessive size thereof. Accordingly, a pier unit formed of FRP (fiberglass reinforced plastic) is produced by hand lay-up, end a pier unit formed of concrete is produced by casting. Transportation of such a huge pier unit from the plant to the shore requires heavy machinery.

Another conventional floating pier 900 will be described with reference to FIGS. 32 and 33. FIG. 32 is a side view of the floating pier 900, and FIG. 33 is a partial cross sectional view of the floating pier 900 taken along line XXXIII—XXXIII in FIG. 32.

The floating pier 900 includes a lengthy frame 91 having a substantially C-shaped cross section having a top portion 91*a* and a bottom portion 91*b*, a deck 92 provided on the top portion 91*a* of the frame 91, and a plurality of floats 93 provided on the bottom portion 91*b* of the frame 91. The deck 92 is secured to the top portion 91*a* of the frame 91 through a bolt and a nut. A flange 94 of each float 93 is also secured to the bottom portion 91*b* of the frame 91 through a bolt and a nut.

The frame 91 is generally formed of a highly rigid steel plate, but such a plate may be bent due to a bending stress or the like when being subjected to a strong force generated by rough water.

FIG. 34 shows the distribution of strain generated in the frame 91, the deck 92 and the float 93 when an external force d (FIG. 32) is applied by the water to the frame 91 so as to expand the gap between adjacent floats 93. In FIG. 34, point O is the point at the center of the frame 91 in the vertical direction, where no strain is generated. Area Q indicates a tensile strain generated in the lower portion of the frame 91, and area R indicates a compressive strain generated in the upper portion of the frame 91. Area P indicates a tensile strain generated in the float 93, and area S indicates a compressive strain generated in the deck 92.

As is appreciated from FIG. 34, when the tensile strain Q is generated in the frame 91, the compressive strain S is generated in the deck 92 by the tensile strain Q. In another case, a tensile strain may be generated in the deck 92, and a compressive strain may be generated in the float 93. In either case, if the tensile strain or the compressive strain is larger than the yield strength of the deck 92 and the float 93, the deck 92 and the float 93 are broken.

Still another conventional floating pier 1000 will be described with reference to FIGS. 35A, 35B and 35C. FIG. 35A is a top view of the floating pier 1000, FIG. 35B is a schematic cross sectional view of the floating pier 1000 taken along lines XXXVB—XXXVB in FIG. 35A, and FIG. 35C is a schematic cross sectional of the floating pier 1000 taken along lines XXXVC—XXXVC in FIG. 35A.

The floating pier 1000 includes a reinforcing member 103, a deck 104 provided on a top surface of the reinforcing member 103, floats 101 provided on a bottom surface of the reinforcing member 103 for supplying the floating pier 1000 with buoyancy. The deck 104 includes a plurality of deck members 102 arranged side by side.

In order to prevent someone walking on the floating pier 1000 from slipping caused by rainwater or waves, water is drained through gaps 102*a* between the deck members 102.

As is illustrated in FIGS. 35B and 35C, water passing through the gaps 102*a* between the deck members 102 drops on the sea below the pier through the reinforcing member 103 and the floats 101. Where the reinforcing member 103 or the float 101 does not exist below the gap 102*a*, the water directly drops on the sea below the pier. In other words, after passing through the gap 102*a*, the water passes through various passages before dropping on the sea below the pier.

In the case where the float 101 has an opening at the top, the water enters the float 101, thus preventing the float 101 from functioning properly. FIG. 36 shows a floating pier 1100 proposed to solve such a problem. A float 111 has an inclined roof. Also, an attaching member 111*a* for attaching the float 111 to a reinforcing member 113 has holes 111*b*, through which the water flows down. In FIG. 36, reference numeral 112 denotes deck members for forming a deck, and reference numeral 112*a* denotes a gap between two adjacent deck members 112.

The floating pier 1100, which has such a complicated structure, is difficult to be molded. Further, since the float 111 has no opening, a ballast for adjusting the center of gravity of the float 111 cannot be put into the float 111. Accordingly, the deck is positioned high above the surface of the sea, which destabilizes the floating pier 1100.

SUMMARY OF THE INVENTION

In one aspect of the present invention, a pier unit includes a float having substantially a box shape with an opening at the top and including a flange extending outward along a top peripheral edge thereof; a rectangular frame attached to the float; a deck provided on the frame; and a connecting member secured to at least one of four corners of the frame for connecting the pier unit to another pier unit.

In one embodiment of the invention, the frame includes a connecting portion and a vertical portion extending from an outer peripheral edge of the connecting portion so that the connecting portion is, in a vertical direction, at a substantially central level of the vertical portion. The deck is secured to a top surface of the connecting portion, and the float is secured to a bottom surface of the connecting portion.

In one embodiment of the invention, the frame defines a gutter for receiving water from a top surface of the pier unit, and has a through-hole for allowing the water to drop from the gutter to a surface of water below the pier unit.

In one embodiment of the invention, the float has ballast accommodating portions at four corners thereof, and contains a foam resin in an area excluding the ballast accommodating portions.

In one embodiment of the invention, the frame is attached to the flange of the float in a watertight manner with a packing interposed therebetween, and the deck is attached to the frame in a watertight manner with another packing interposed therebetween.

In one embodiment of the invention, the pier unit further includes a surface board provided on the deck for improving the appearance of the pier unit.

In one embodiment of the invention, the pier unit further includes a fender which is attached to an outer vertical portion extending from an outer peripheral edge of the frame.

In one embodiment of the invention, at least one of the frame, the deck and the float is formed of a fiber reinforced thermoplastic resin.

In one embodiment of the invention, the pier unit further includes a plurality of pier units according to claim 1, wherein the connecting members of the pier units are connected to each other by a connecting piece.

In one embodiment of the invention, the frame of each pier unit includes a connecting portion, an upper portion extending upward from an outer peripheral edge of the connecting portion, and a lower portion extending downward from the outer peripheral edge of the connecting portion. The connecting member of each pier unit has a taper surface and is provided on a top surface of the connecting portion so as to be flush against the upper portion, and another connecting member having a taper surface is provided on a bottom surface of the connecting portion so as to be flush against the lower portion. The floating pier further includes a connecting piece having an inclined portion and covering the upper connecting members of the plurality of pier units, a connecting piece having an inclined portion and covering the lower connecting members of the plurality of pier units and further having a guide member extending from a bottom surface thereof, and a tap plate provided below the lower connecting piece. The plurality of pier units are connected to each other by tightening a bolt inserted into the upper connecting piece, the lower connecting piece and the tap plate to pressure-contact the inclined portions of the connecting pieces on the taper surfaces of the connecting members, while the tap plate is prevented from rotating by the guide member thereof.

In another aspect of the present invention, a floating pier including a plurality of substantially rectangular pier units connected to each other includes a connecting portion extending from a side surface of each pier unit; an upper portion extending upward from an outer peripheral edge of the connecting portion; a lower portion extending downward from the outer peripheral edge of the connecting portion; a connecting member having a taper surface and provided on a top surface of the connecting portion so as to be flush against the upper portion; another connecting member having a taper surface and provided on a bottom surface of the connecting portion so as to be flush against the lower portion; a connecting piece having an inclined portion and covering the upper connecting members of the plurality of pier units; another connecting piece having an inclined portion and covering the lower connecting members of the plurality of pier units and further having a guide member extending from a bottom surface thereof; and a tap plate provided below the lower connecting piece. The plurality of pier units are connected to each other by tightening a bolt inserted into the upper connecting piece, the lower connecting piece and the tap plate to pressure-contact the inclined portions of the connecting pieces on the taper surfaces of the connecting members, while the tap plate is prevented from rotating by the guide member thereof.

In still another aspect of the present invention, a pier unit includes a frame; a deck provided on the frame; and a float provided below the frame. The frame includes a connecting portion and a vertical portion extending from an outer peripheral edge of the connecting portion and integrally formed therewith so that the connecting portion is, in a vertical direction, at a substantially central level of the vertical portion, and the deck is secured to a top surface of the frame and the float is secured to a bottom surface of the frame.

In still another aspect of the present invention, a pier unit includes a float; a frame attached to the float; and a deck provided on the frame. The frame defines a gutter for receiving water from a top surface of the pier unit and has a through-hole for allowing the water to drop from the gutter to a surface of water below the pier unit.

According to the present invention, by tightening a bolt attached to the top connecting pieces, a plurality of, for example, four pier units can be connected to each other while a tap plate attached to the bottom connecting piece is prevented from rotating. Since the bolt tightening only from the top is sufficient, the connection is relatively easy. Further, the connection is simplified because it is performed only by pressure-contacting the taper surface of the connecting member and the inclined portion of the connecting piece. Accordingly, the number of steps can be significantly reduced.

According to the present invention, the connecting portion used for securing the deck and the float to the frame has a significantly smaller size in the vertical direction than that of the vertical portion extending from the connecting portion. Due to such a shape, even if the frame is subjected to a large external force, the deck and the float secured to the connecting portion of the frame receives only a small amount of stress, thus protecting the deck and the float from destruction.

According to the present invention, water flows down through the through-hole in the gutter and then runs along a constant path without running along the reinforcing member or a top part of the float. Further, in the case where the gutter has a substantially C-shaped vertical cross section having an opening at the top and is disposed below the deck, extra work such as attaching and securing the gutter can be eliminated as opposed to the case where a separate gutter is provided.

Thus, the invention described herein makes possible the advantages of (1) providing a pier unit which is relatively easy to produce using a molding apparatus and is also relatively easy to transport, and a floating pier including a plurality of such pier units; (2) providing a floating pier including a deck and a float which are strong and thus resistant to external forces; and (3) providing a floating pier having a constant drainage passage for water which has passed through the gaps between the deck members.

These and other advantages of the present invention will become apparent to those skilled in the art upon reading and understanding the following detailed description with reference to the accompanying figures.

DESCRIPTION OF THE PREFERRED EMBODIMENTS

Figure 1:
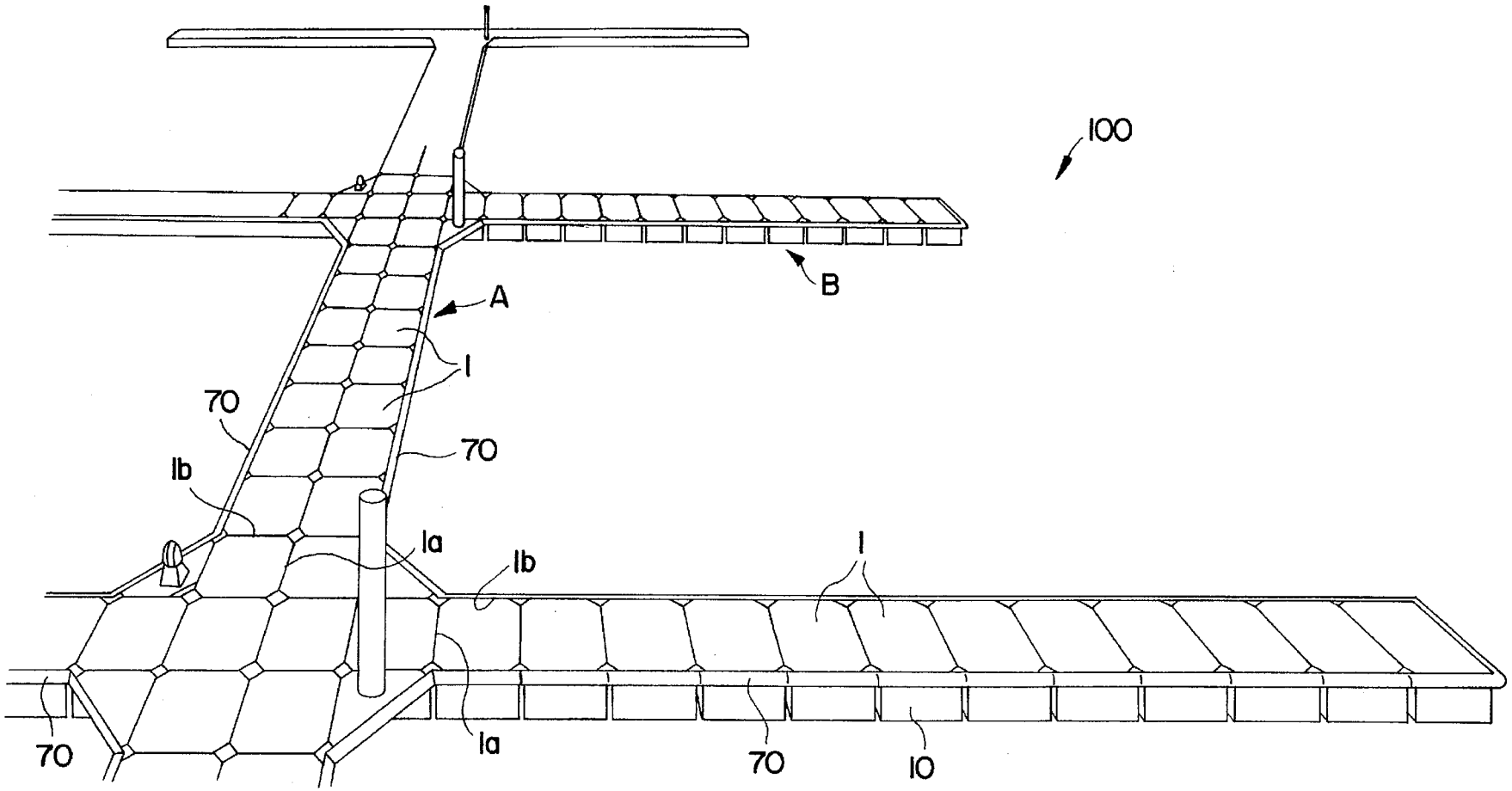
FIG. 1 is a perspective view of a floating pier 100 in an example according to the present invention.

Hereinafter, the present invention will be described by way of illustrative examples with reference to the accompanying drawings. Elements which are common in the following examples bear the same reference numerals, and explanation thereof may be omitted.

EXAMPLE 1

A floating pier 100 in a first example according to the present invention will be described.

As is shown in FIG. 1, the floating pier 100 includes a plurality of rectangular pier units 1 connected to one another.

The shape of the floating pier 100 can be changed by changing the manner of connecting the pier units 1. For example, a main path A of the floating pier 100 is formed by connecting a plurality of pairs of pier units. In more detail, a pair of pier units are connected along longer sides 1*a* thereof, and a plurality of pairs of pier units are connected along longer sides of the pair (2×1*b*). A branch path B is formed by connecting a plurality of pier units 1 along longer sides 1*a* thereof. The floating pier 100 is provided with a fender 70 along the periphery thereof.

Figure 2:
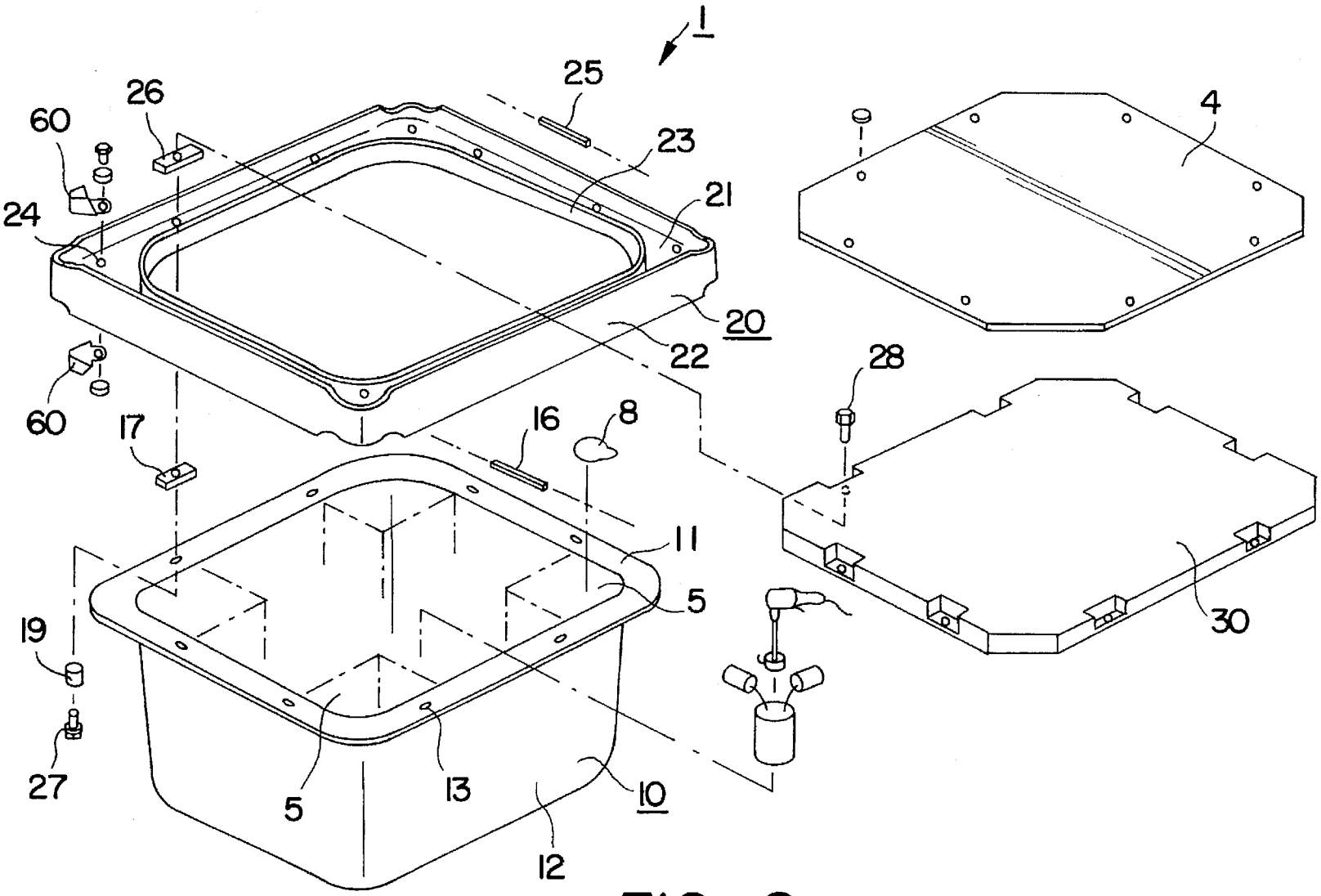
FIG. 2 is an exploded isometric view of the floating pier shown in FIG. 1.

FIG. 2 is an exploded isometric view of the pier unit 1. The pier unit 1 includes a float 10 formed of a resin (for example, a thermoplastic resin), a rectangular frame 20 also formed of a resin secured to the float 10, a deck 30 secured to the frame 20, and a surface plate 4 secured to the deck 30. The float 10 has a shape of a cubic box with an opening at the top, each of four sides of the opening being approximately 1 meter. The rectangular frame 20 has a rectangular opening at the center.

Figure 5A:
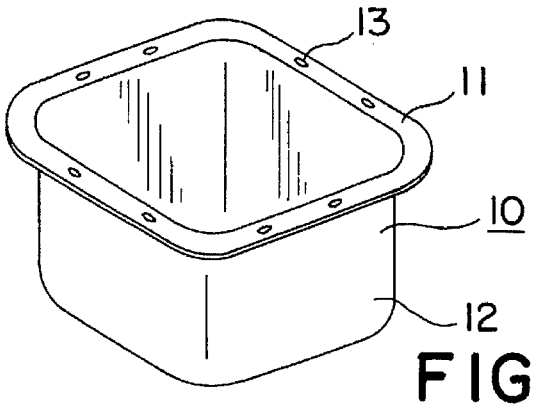
FIG. 5A is an isometric view of a float of the pier unit shown in FIG. 2.
Figure 5B:
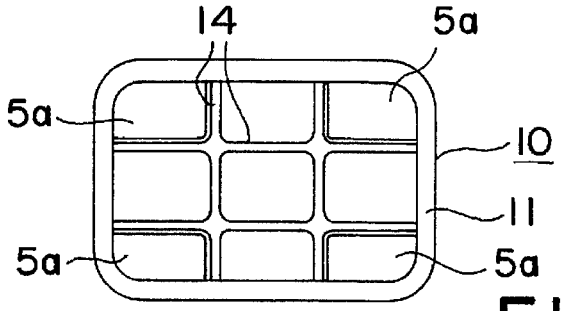
FIG. 5B is a plan view thereof.
Figure 8B:
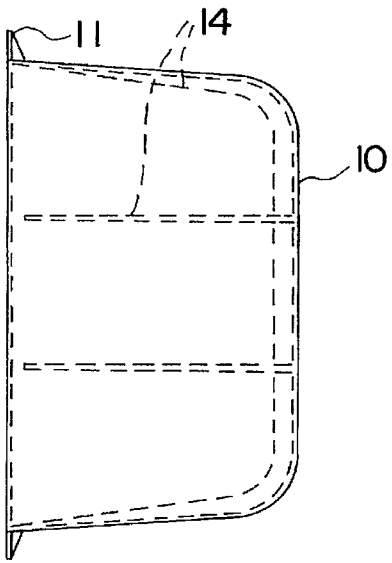
FIG. 8B is a side view thereof in the direction of arrow C.
Figure 8A:
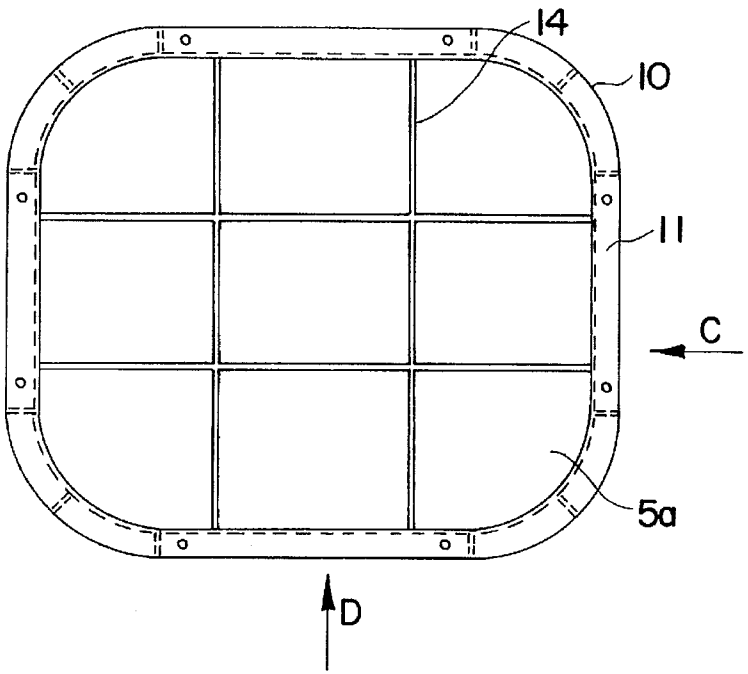
FIG. 8A is a plan view of the float shown in FIGS. 5A and 5B.
Figure 8C:
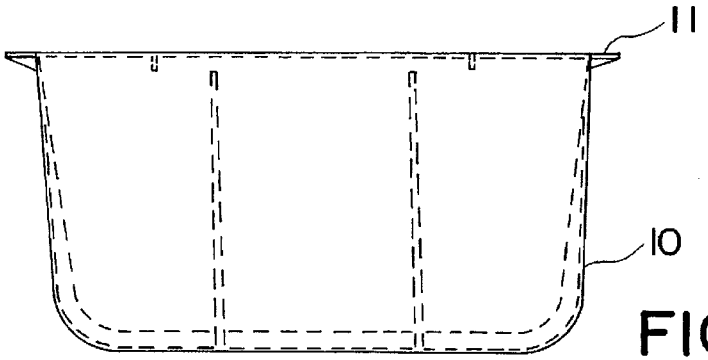
FIG. 8C is a side view thereof in the direction of arrow D.

With reference to FIGS. 5A, 5B, 8A, 8B and 8C, the float 10 will be described. FIG. 5A is an isometric view of the float 10, FIG. 5B is a top view of the float 10. FIG. 8A is an enlarged top view of the float 10, FIG. 8B is a side view thereof in the direction of arrow C in FIG. 8A, and FIG. 8C is a side view thereof in the direction of arrow D in FIG. 8A.

The float 10 includes a float body 12 having a shape of a cubic box with an opening at the top, and a flange 11 extending outward from a peripheral top edge of the float body 12. The flange 11 has a plurality of through-holes, through which bolts are to be inserted.

Figure 7:
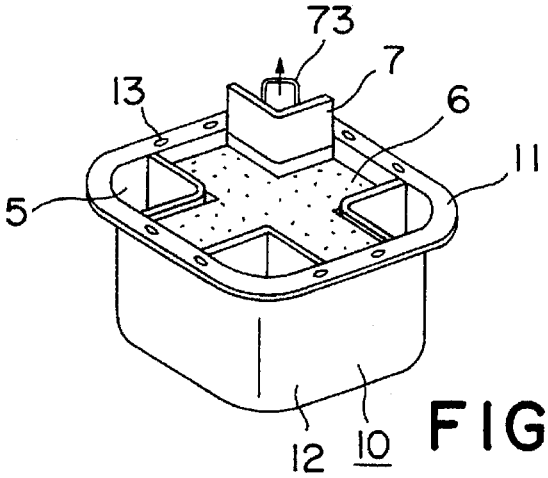
FIG. 7 is an isometric view of the float shown in FIGS. 5A and 5B in the state of containing foam resin therein.

The float 10 has reinforcing ribs inner bottom surface and inner side surfaces thereof, Each rib 14 has a height of approximately 20 to 40 mm. The ribs 14 formed on the inner bottom surface of the float 10 define four areas 5*a*, each of which becomes an inner bottom surface of a ballast accommodating portion 5 (FIG. 7). As is also shown in FIG. 7, a central area of the float body 12 excluding the ballast accommodating portions 5 is filled with a foam resin 6.

In the following manner, the ballast accommodating portions 5 are formed and the remaining area is filled with the foam resin 6.

Figure 6:
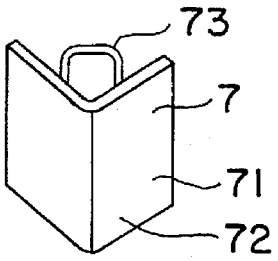
FIG. 6 is an isometric view of a frame used to inject a foam resin in the float shown in FIGS. 5A and 5B.

An L-shaped forming member 7 shown in FIG. 6 is covered with a vinyl sheet 72, which is secured on an inner surface of the forming member 7 by an adhesive tape. The forming member 7 has a handle 73 on a top edge thereof. Such an L-shaped forming member 7 is placed along and inside the rib 14 which defines each of the four areas 5*a*. In this state, the foam resin 6 is injected into the central area of the float body 12 and is foamed and cured. After the foam resin 6 is completely foamed, the forming member 7 is pulled out of the float body 12 using the handles 73, thus to form ballast accommodating portions 5 at four corners of the float body 12. At this point, the vinyl sheets 72 are left in the float body 12 in the state of adhering to the foam resin 6. Thus, the L-shaped forming members 7 can be pulled out with satisfactory releasability. As the foam resin 6, a two-liquid type hard foam urethane resin can be used. The expansion ratio is preferably approximately 30 times.

The foam resin 6 provided In the float 10 prevents water from entering inside the float 10 even if the float body 12 is damaged. Even if water enters the float 10, the float 10 is provided with buoyancy by the foam resin 6. Ballast 8 provided in the ballast accommodating portions S at the four corners of the float 10 adjusts the center of gravity of the float 10, thus enhancing the stability of the float 10 in the sea.

Figure 9A:
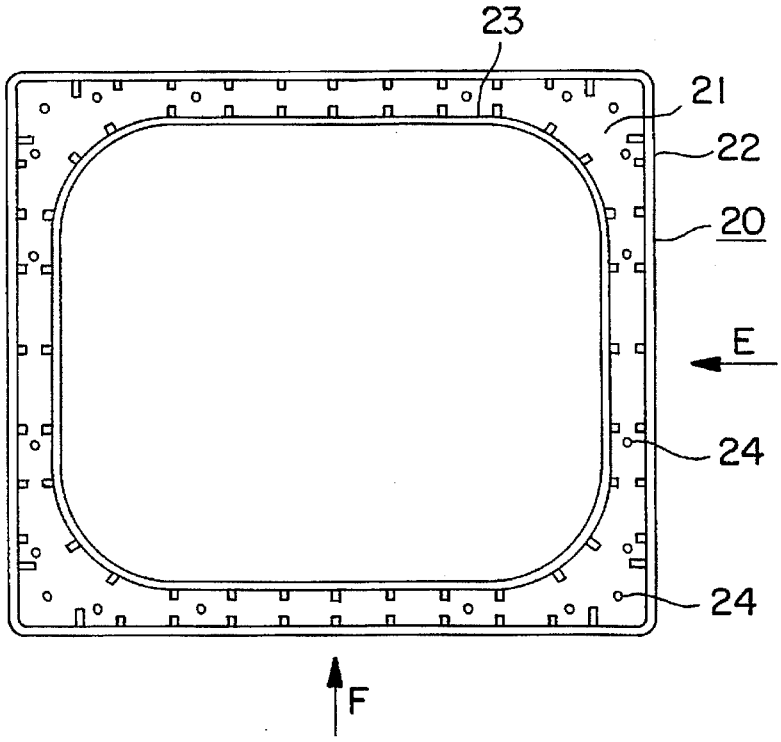
FIG. 9A is a plan view of a frame shown in FIG. 2.
Figure 9B:
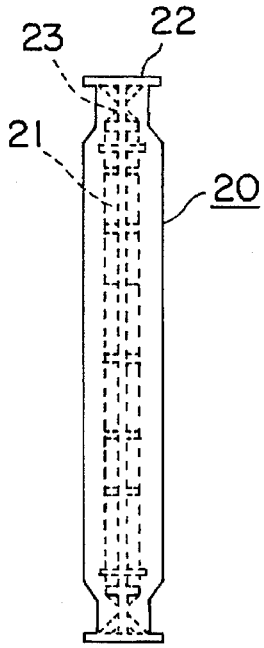
FIG. 9B is a side view thereof in the direction of arrow E.
Figure 9C:
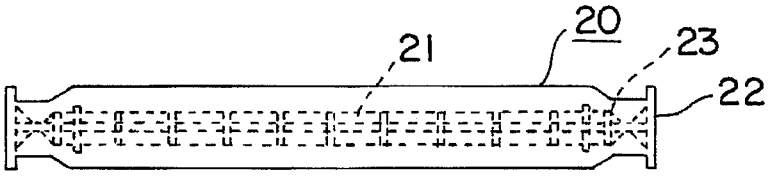
FIG. 9C is a side view thereof in the direction of arrow F.

With reference to FIGS. 9A, 9B and 9C, the frame 20 will be described. FIG. 9A is a top view of the frame 20, FIG. 9B is a side view thereof in the direction of arrow E in FIG. 9A, and FIG. 9C is a side thereof in the direction of arrow F in FIG. 9A.

The frame 20 is formed of, for example, a fiber reinforced thermoplastic resin (hereinafter, referred to as FRTP). The frame 20 includes a connecting portion 21, an outer portion 22 extending vertically upward and downward from an outer periphery of the connecting portion 21, and an inner portion 23 extending vertically upward and downward from an inner periphery of the connecting portion 21. The connecting portion 21 has through-holes 24 at four corners thereof and in four portions between the corners, through which bolts are to be inserted.

Figure 15A:
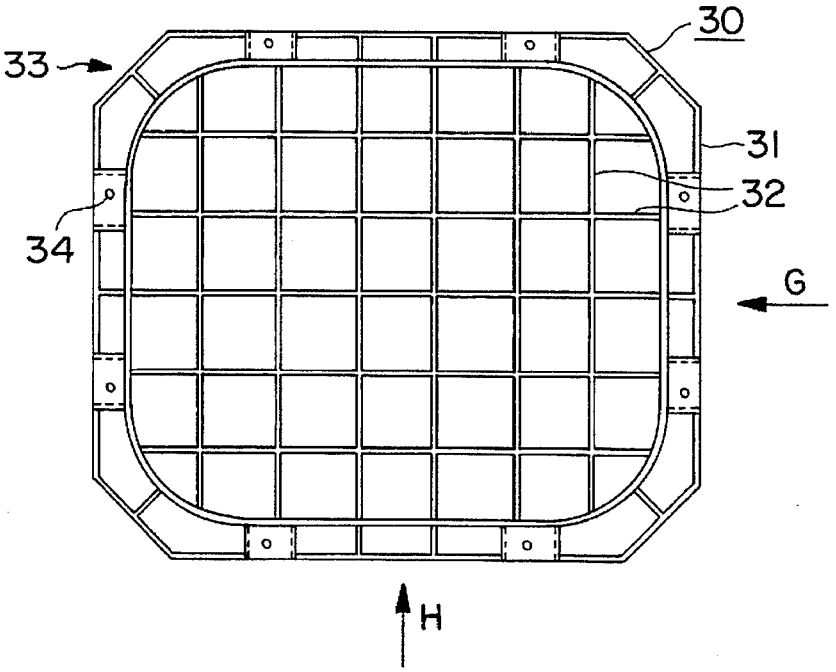
FIGS. 15A is a plan view of the deck shown in FIG. 2.
Figure 15B:
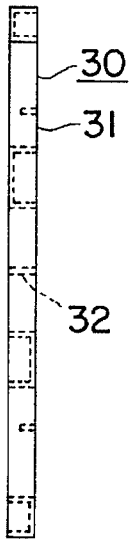
FIG. 15B is a side view thereof in the direction of arrow G.
Figure 15C:
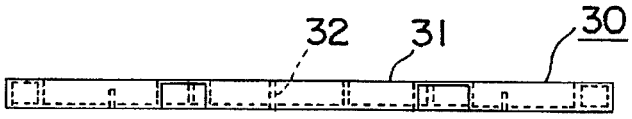
FIG. 15C is a side view thereof in the direction of arrow H.

With reference to FIGS. 15A, 15B and 15C, the deck 30 will be described. FIG. 15A is a top view of the deck 30, FIG. 15B is a side view thereof in the direction of arrow G in FIG. 15A, and FIG. 15C is a side thereof in the direction of arrow H in FIG. 15A The deck 30 is formed of, for example, FRTP and includes a main body 31 and a plurality of ribs 32 provided on the main body 31. The deck 30 is substantially rectangular and has oblique cutouts 33 at four corners thereof. The main body 31 has through-holes 34 in four portions thereof between the corners, through which bolts are to be inserted.

The surface plate 4, which is provided to improve the appearance, has a shape corresponding to the deck 30 as is shown in FIG. 2.

The pier unit 1 is assembled in the following manner.

Figure 10:
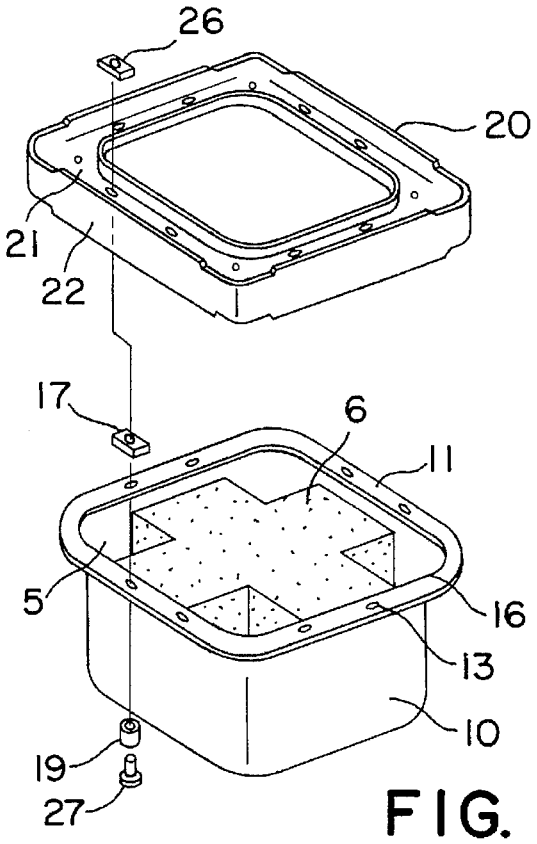
FIG. 10 is an exploded isometric view of the pier unit, illustrating attachment of the frame to the float.
Figure 11:
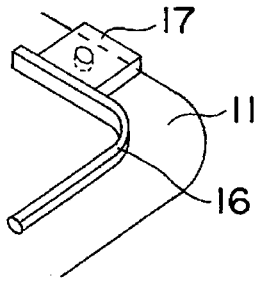
FIG. 11 is a partial isometric view of the float shown in FIG. 10.
Figure 12:
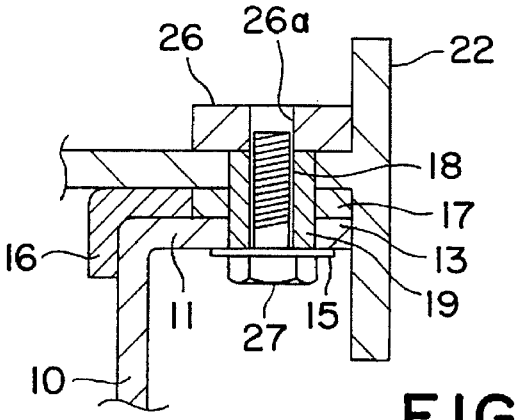
FIG. 12 is a cross sectional view, illustrating connection of the frame and the float shown in FIG. 10.

As is shown in FIGS. 10 through 12, a packing manner. 16 formed of butyl rubber or the like is bonded along an inner edge of the flange 11, located next to the outer surface of the collar 19 facing inward to the inside of the flange 11. Rubber cushions 17 are provided on the flange 11 outside the packing 16. The rubber cushions 17 each have a through-hole 18, and are disposed so as to align the through-holes 18 with the through-holes 13 of the flange 11.

Next, the frame 20 is placed on the flange 11 so that the outer portion 22 is outside the flange 11 and that the inner portion 23 is inside the flange 11. Thus, the packing 16 and the rubber cushions 17 are compressed between the float 10 and the connecting portion 21 of the frame 20.

Figure 14:
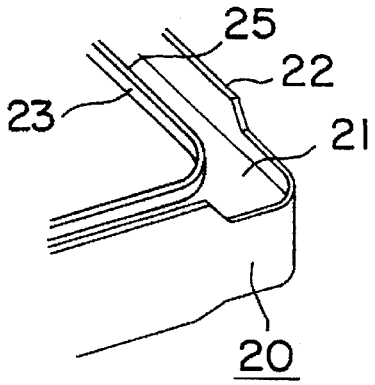
FIG. 14 is a partial isometric view of the frame shown in FIG. 13.

Then, as is shown in FIG. 14, a rubber seal 25 formed of butyl rubber or the like is bonded on the entire top edge of the inner portion 23 of the frame 20, As is shown in FIGS. 10 and 12, tap blocks 26 are provided on the connecting portion 21. The tap blocks 26 each have a through-hole 26*a* which is threaded at a top portion and a bottom portion thereof, and are disposed so as to align the through-holes 26*a* with the through-holes 24 of the frame 20. As is shown in FIG. 12, a bolt 27 is inserted from bottom of the flange 11 of the float 10 to be engaged with the tap block 26 through a spring washer 15 and a collar 19. The collar 19 is formed of a metal and prevents the bolt 27 from loosening. In this manner, the frame 20 is secured to the float 10.

Figure 13:
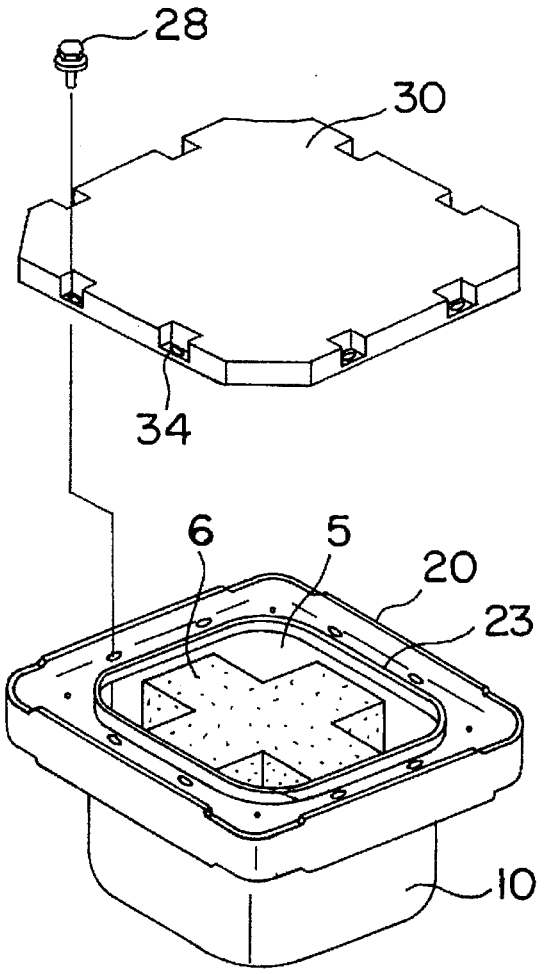
FIG. 13 is an exploded isometric view of the pier unit, illustrating attachment of a deck to the frame.

Then, as is shown in FIG. 13, the deck 30 is secured on the frame 20 by bolts 28 inserted into the through-holes 34 of the deck 30 and the through-holes 26*a* of the tap blocks 26.

Figure 16:
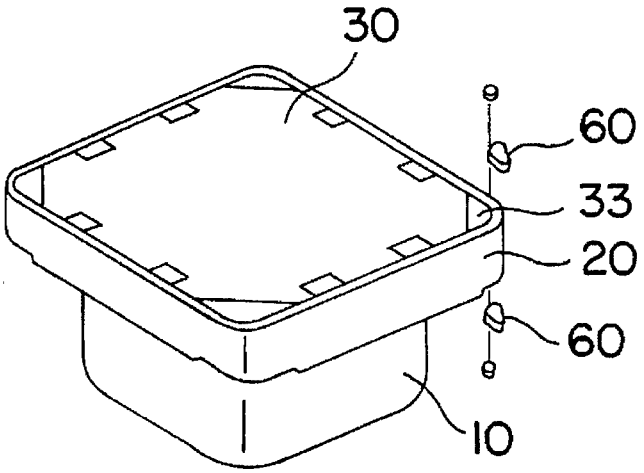
FIG. 16 is an isometric view of the assembly of the deck, the frame and the float.

Then, as is shown in FIG. 16, a pair of connecting members 60 are respectively secured on a top surface and a bottom surface of the connecting portion 21 of the frame 20 through the cutout 33 of the deck 30. Then, the surface plate 4 is secured by pins. In this manner, the assembly of the pier unit 1 is completed.

Hereinafter, the connection of a plurality of such pier units 1 will be described.

First, the connecting member 60 secured to the connecting portion 21 of the frame 20 will be described.

Figure 19A:
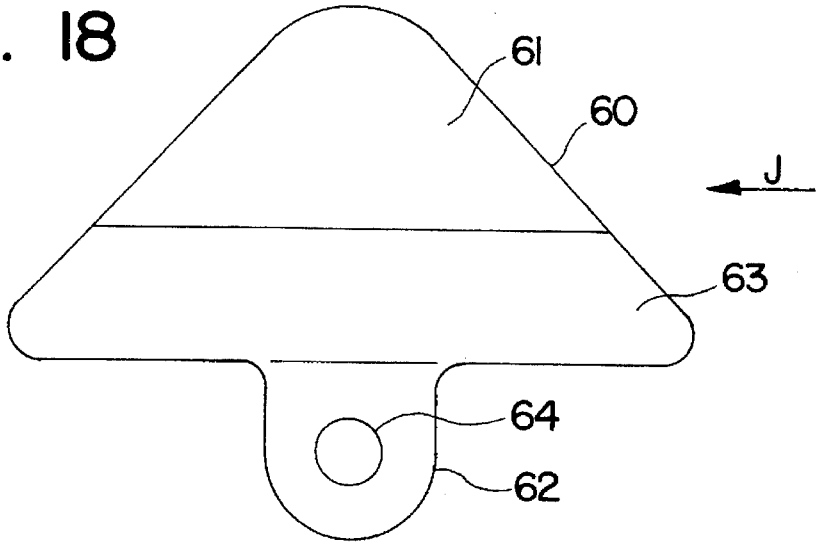
FIG. 19A is a plan view of a connecting member to be secured to the frame.
Figure 19B:
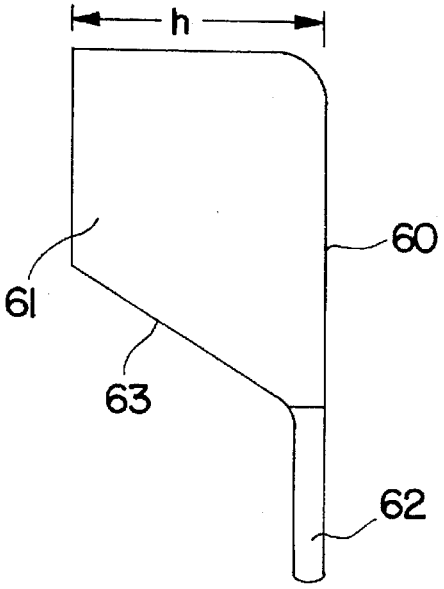
FIG. 19B is a side view thereof in the direction of arrow J.

FIG. 19A is a top view of the connecting member 60, and FIG. 19B is a side view thereof in the direction of arrow J.

The connecting member 60 is formed of a rigid material such as a metal, and includes a head portion 61 having a substantially right-angled triangular planar shape and an attachment portion 62 horizontally extending from the hypotenuse of the head portion 61. A portion in the vicinity of the hypotenuse has a tapered surface 63 which is inclined downward from the substantial apex side of the head portion 61 toward the attachment portion 62. The height h of the head portion 61 is designed to be slightly less than the height of the outer portion 22 of the frame 20 measured from the connecting portion 21. The attachment portion 62 has a through-hole 64.

Four pairs of connection members 60 are secured to the top surface and the bottom surface of the connecting portion 21 at the four corners by a bolt and a nut inserted through the through-hole 64 and the through-hole 24 formed at each of four corners of the connecting portion 21.

For connecting the pier units 1, two types of connecting pieces 40 are used, namely, connecting pieces 40A used for connecting four pier units 1 and connecting pieces 40B used for connecting two pier units 1.

First, the connecting pieces 40A for connecting four pier units 1 will be described.

A connecting piece 40A is provided on the connecting member 60 which is provided on the top surface of the connecting portion 21, and another connecting piece 40A is provided on the connecting member 60 which is provided on the bottom surface of the connecting portion 21. For simplicity, the connecting member 60 provided on the top surface will be referred to as the "top connecting member 60", and the connecting member 60 provided on the bottom surface will be referred to as the "bottom connecting member 60". The connecting piece 40A provided on the top connecting member 60 will be referred to as the "top connecting piece 40A", and the connecting piece 40A provided on the bottom connecting member 60 will be referred to as the "bottom connecting piece 40A".

Figure 20A:
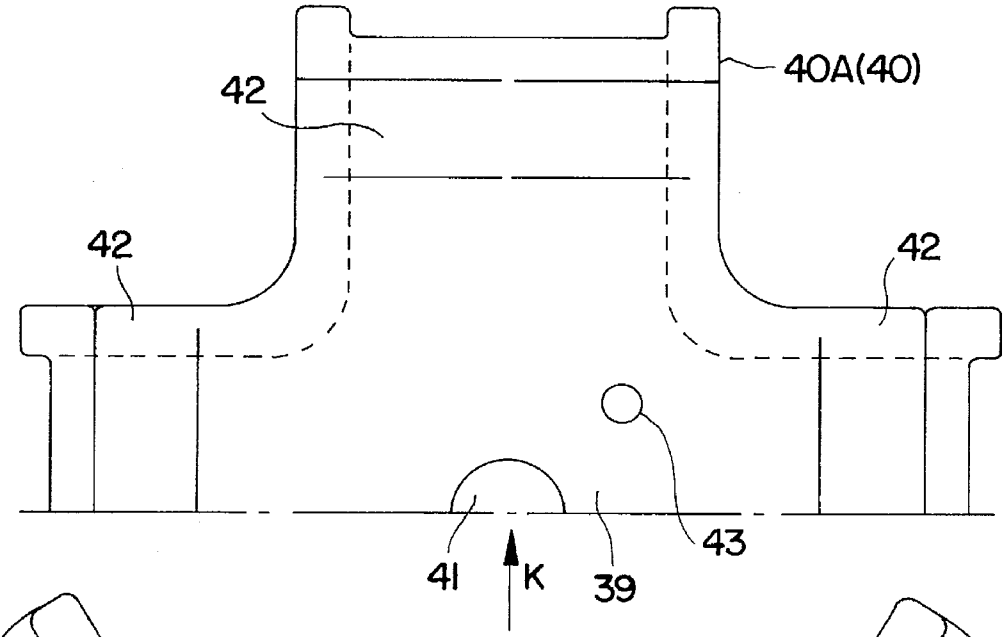
FIG. 20A is a half plan view of a connecting member for connecting four pier units.
Figure 20B:
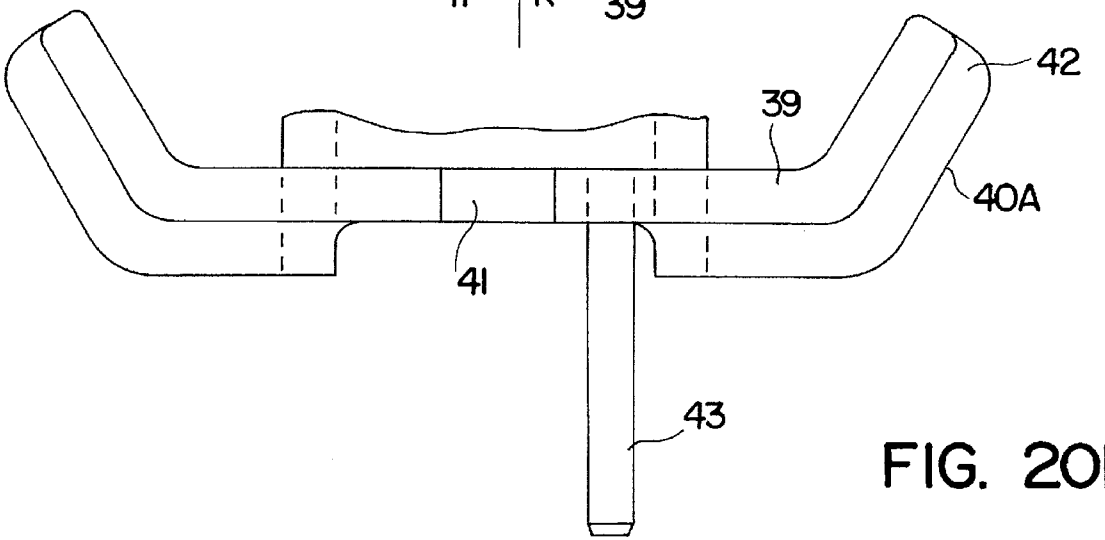
FIG. 20B is a partially cut side thereof in the direction of arrow K.

FIG. 20A is a half plan view of the bottom connecting piece 40A, and FIG. 20B is a partially cut side view thereof in the direction of arrow K.

As is shown in FIGS. 20A and 20B, the bottom connecting piece 40A includes a central portion 39 and four inclined portions 42. The central portion 39 has a through-hole 41, through which a bolt 9 (FIG. 4) is to be inserted. The bottom connecting piece 40A further has a guide pin 43 vertically extending downward from a bottom surface thereof. The bottom connecting piece 40A is provided on the bottom connecting members 60 in the state where the inclined portions 42 abut against the taper surfaces 63.

The top connecting piece 40A has the same structure except that the guide pin 43 is not included.

Now, the connecting piece 40B for connecting two pier units 1 will be described.

A connecting piece 40B is provided on the top connecting member 60, and another connecting piece 40B is provided on the bottom connecting member 60. The connecting piece 40B provided on the top connecting member 60 will be referred to as the "top connecting piece 40B", and the connecting piece 40B provided on the bottom connecting member 60 will be referred to as the "bottom connecting piece 40B".

Figure 21A:
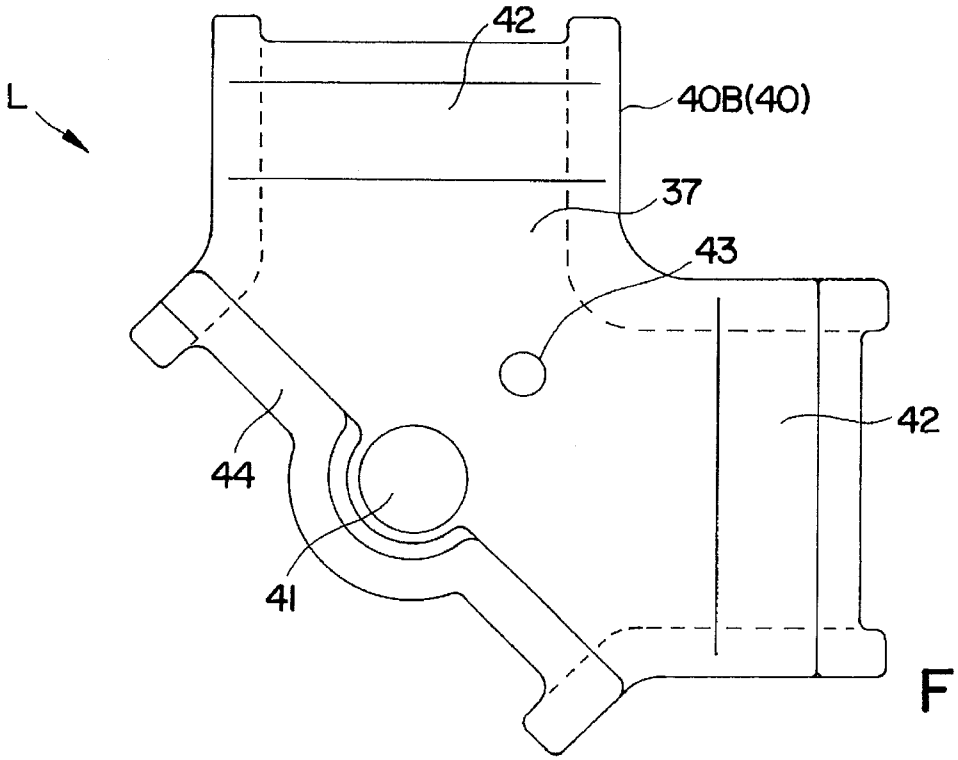
FIG. 21A is a plan view of a connecting member for connecting two pier units.
Figure 21B:
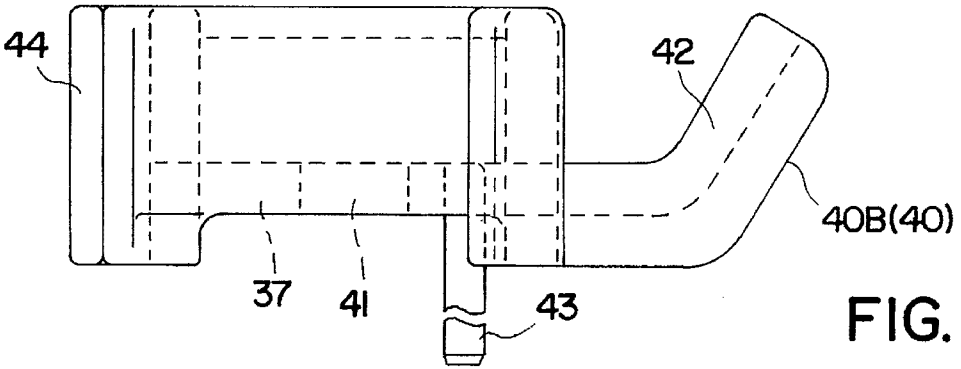
FIG. 21B is a partially cut side thereof in the direction of arrow L.

FIG. 21A is a plan view of the bottom connecting piece 40B, and FIG. 21B is a side view thereof in the direction of arrow L.

As is shown in FIGS. 21A and 21B, the bottom connecting piece 40B includes a central portion 37, two inclined portions 42, and a vertical portion 44. The central portion 37 has a through-hole 41 in the vicinity of the vertical portion 44, through which a bolt 9 (FIG. 4) is to be inserted. The bottom connecting piece 40B further has a guide pin 43 vertically extending from a bottom surface thereof. The bottom connecting piece 40B is provided on the bottom connecting members 60 in the state where the inclined portions 42 abut against the taper surfaces 63.

The top connecting piece 40B provided on the top connecting member 60 has the same structure except that the guide pin 43 is not included.

Hereinafter, connection of a plurality of pier units 1 using the top and bottom connecting piece 40A will be described.

Figure 3:
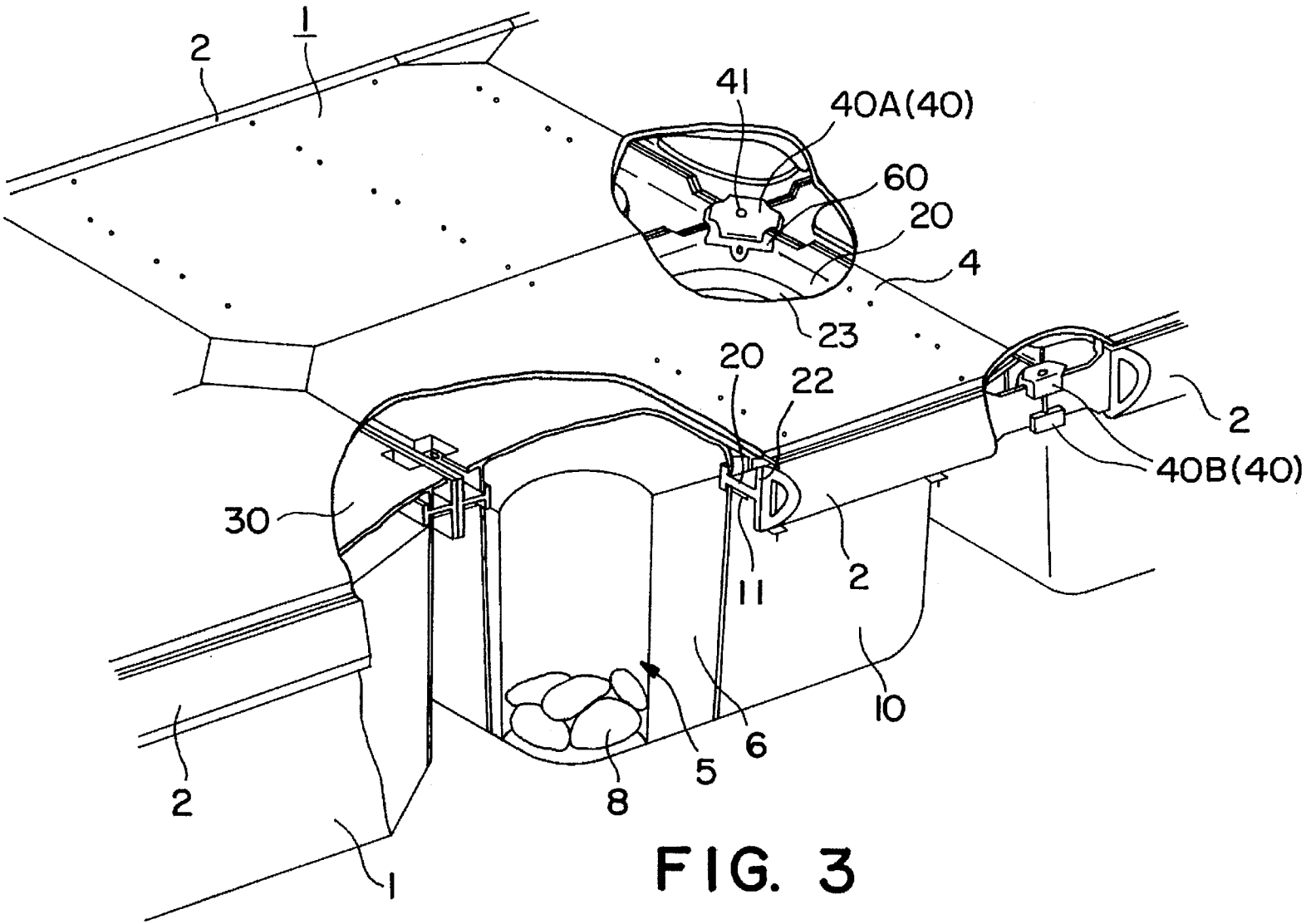
FIG. 3 is a partially cut partial isometric view of the floating pier shown in FIG. 1.
Figure 24:
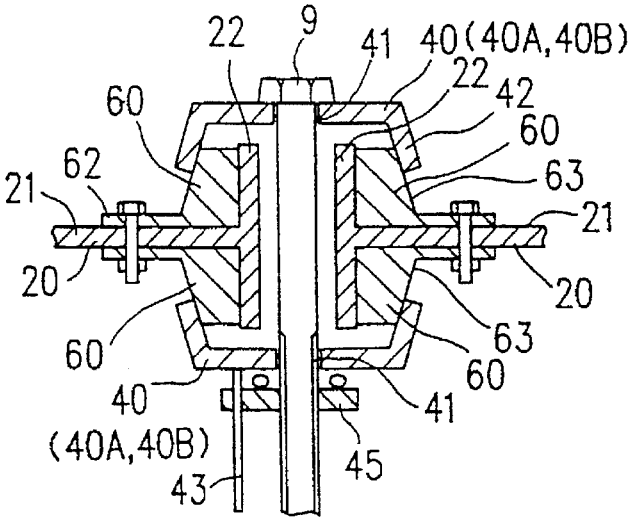
FIG. 24 is a cross sectional view, illustrating the connection of two adjacent pier units.

As is shown in FIGS. 3 and 24, top and bottom connecting members 60 are respectively secured to the top and bottom surfaces at a corner of the connecting portion 21 of the frame 20 of the pier unit 1. In the same manner, another three sets of top and bottom connecting members 60 are secured to the connecting portions 21 of another three frames 20 to be connected. These frames 20 are arranged so that the corners thereof are in contact to one anther.

Figure 25:
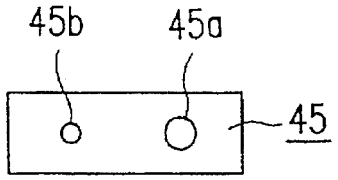
FIG. 25 is a plan view of a tap plate used to connect the pier units.

Then, top and bottom connecting pieces **40*a* are placed so as to hold the connecting members 60 from top and bottom. The bolt 9 is inserted into the through-holes 41 of the two connecting pieces 40A, and a tap plate 45 is inserted in the following manner. As is shown in FIG. 25, the tap plate 45 has a tap hole 4*a* and a guide hole 45*b*. In the state where the guide pin 43 is inserted into the guide hole 45*b*, the bolt 9 is screwed into the tap hole 45*a*. In this manner, the tap plate 45 is prevented from horizontally rotating. As the bolt 9 is screwed more tightly, the distance between the two connecting pieces 40A is shortened. Thus, the inclined portions 42 of the two connecting pieces 40A are pressure-contacted on the corresponding taper surfaces 63. In this manner, the four pier units 1** are connected with sufficient strength while becoming closer to one another.

Figure 4:
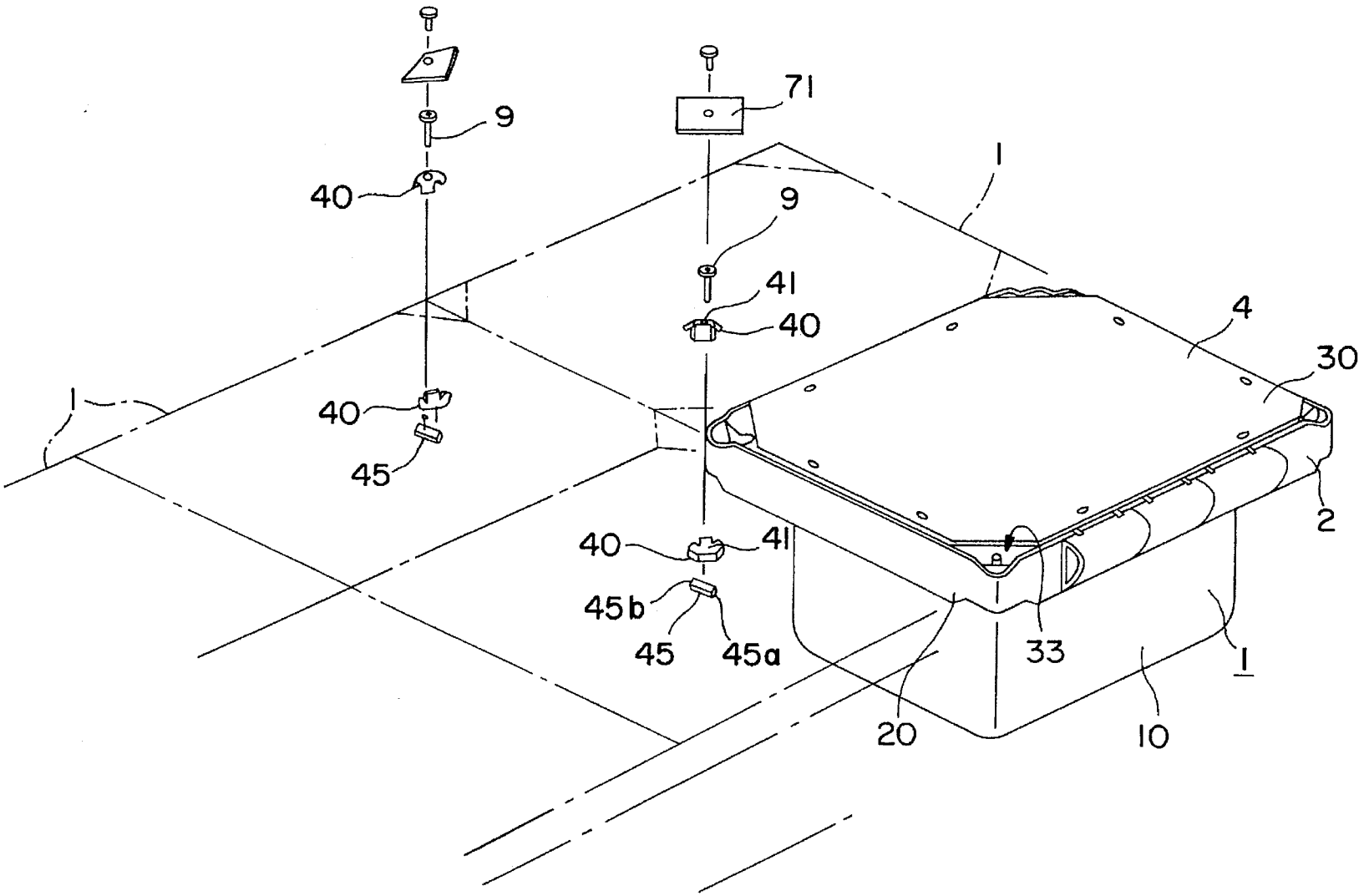
FIG. 4 is an isometric view of the floating pier shown in FIG. 1, illustrating the connection of a plurality of pier units.

After the four pier units 1 are connected in this manner, a surface plate 71 is secured on the area defined by the cutouts 33 by a screw as is shown in FIG. 4.

The connecting pieces 40B are used in the same manner to connect two pier units 1 (FIG. 4).

Use of the connecting pieces 40A allows a plurality of, for example, four pier units 1 to be connected simultaneously, and further reduces the number of steps of assembly because the connection is achieved by pressure contact of the taper surface 63 of the connecting member 60 and the inclined portion 42 of the connecting piece 40A. Since the use of the tap plate 45 prevents the lower connecting piece 40A from rotating, the floating pier 100 can easily be assembled by operation from the top surface. Use of the connecting pieces 40B allows two pier units 1 to be connected in the same manner.

The guide pin 43 can be replaced with a guide piece which is engageable with a peripheral edge of the tap plate 45. The members and parts of the pier unit 1 can be formed of various materials such as metal and reinforced plastic.

After the connection of the pier units 1, the fender 70 is attached to the frame 20 in the following manner.

Figure 17:
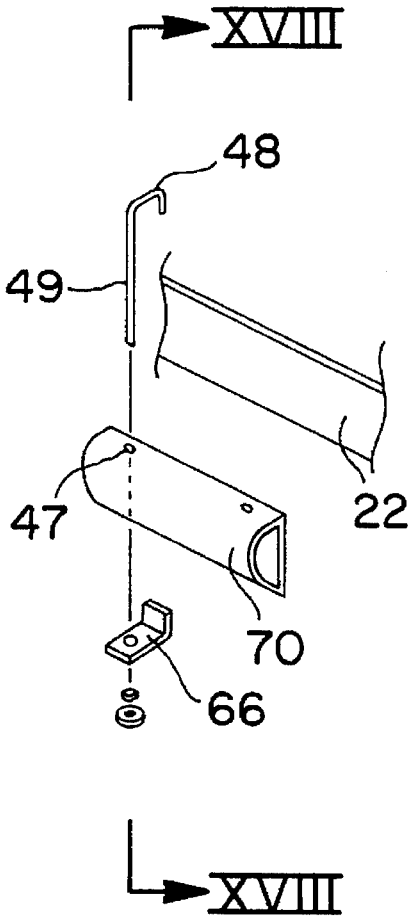
FIG. 17 is an exploded isometric view of a fender to be attached to the frame.
Figure 18:
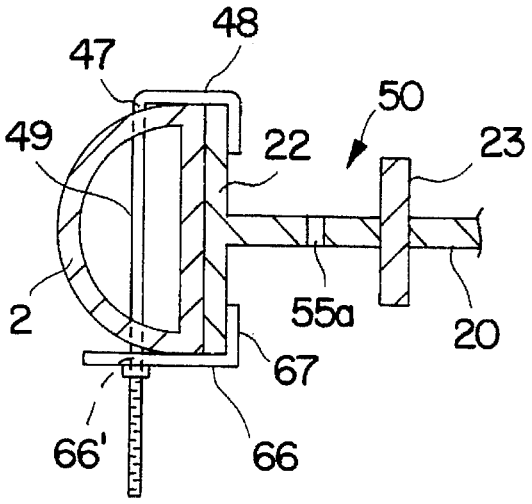
FIG. 18 is a cross sectional view of the fender attached to the frame along lines XVIII—XVIII in FIG. 17.

The fender 70, which is formed of an elastic synthetic resin, rubber or the like, has two through-holes 47 as is shown in FIGS. 17 and 18. FIG. 17 is an exploded isometric view of the fender 70 to be attached to the frame 20, and FIG. 18 is a cross sectional view of the fender 70 attached to the frame 20 along lines XVIII—XVIII in FIG. 17.

A bolt 49 having a hook portion 48 at a top end thereof is inserted into each of the two through-holes 47, and the hook portion 48 is engaged with the outer portion 22 of the frame 20. An L-shaped piece 66 having a through-hole 66' and a vertical portion 67 is attached in the state where a threaded portion at the bottom of the bolt 49 is in engagement with the through-hole 66' and where the outer portion 22 is flush against the vertical portion 67. In this state, the L-shaped piece 66 is tightened by a nut, thus securing the fender 70 to the frame 20.

As is shown in FIG. 18, a gutter 50 for receiving water flowing on the floating pier 100 is formed between the outer portion 22 and the inner portion 23 of the frame 20. The gutter 50 has a through-hole **55*a*, through which the water drops onto the sea surface below. Although not shown, such a gutter 55 is also formed between two adjacent pier units 1**.

In the floating pier 100 in the first example, the parts of the pier unit 1 can be molded sufficiently easily. Each pier unit 1 is sufficiently small to be easily transported.

The formation of the parts of the pier unit 1 of FRTP, which can be recycled, solves the problem of waste of large-scale marine structures which has been a serious environmental problem.

Since the pier units 1 are connected along the frames 20 thereof, the floating pier 100 is not swung significantly by a localized load generated when, for example, someone walks thereon. An experiment was performed to indicate the movement of the floating pier 100 as follows.

Figure 22:
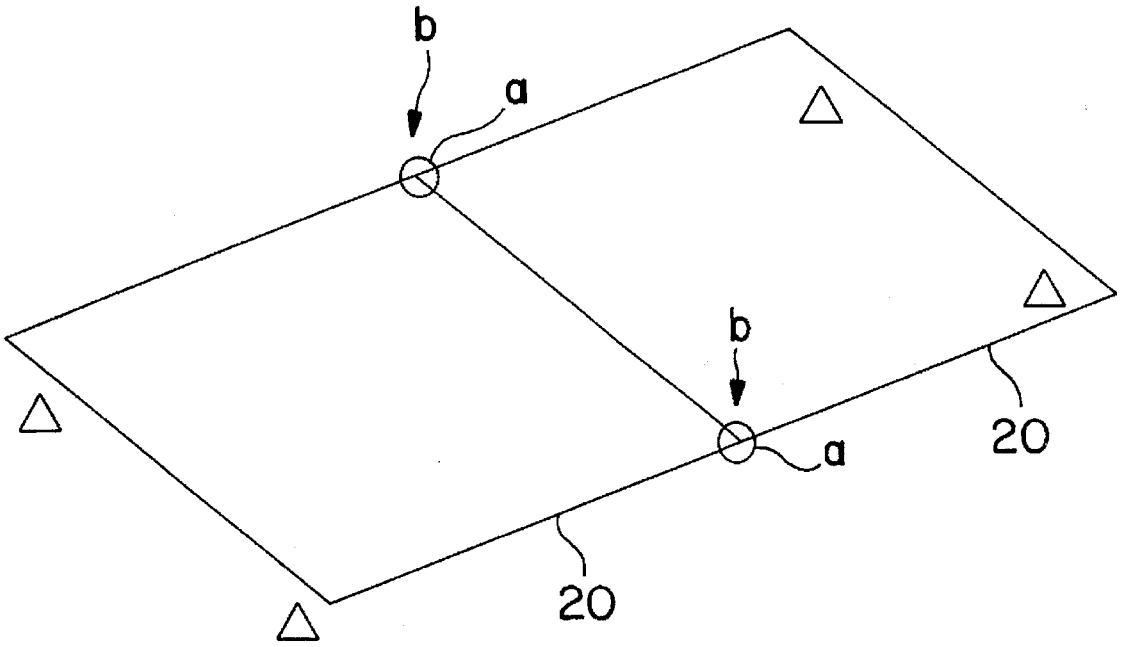
FIG. 22 is a schematic isometric view of two pier units used in an experiment to show the relationship between the load applied thereto and the displacement.
Figure 23:
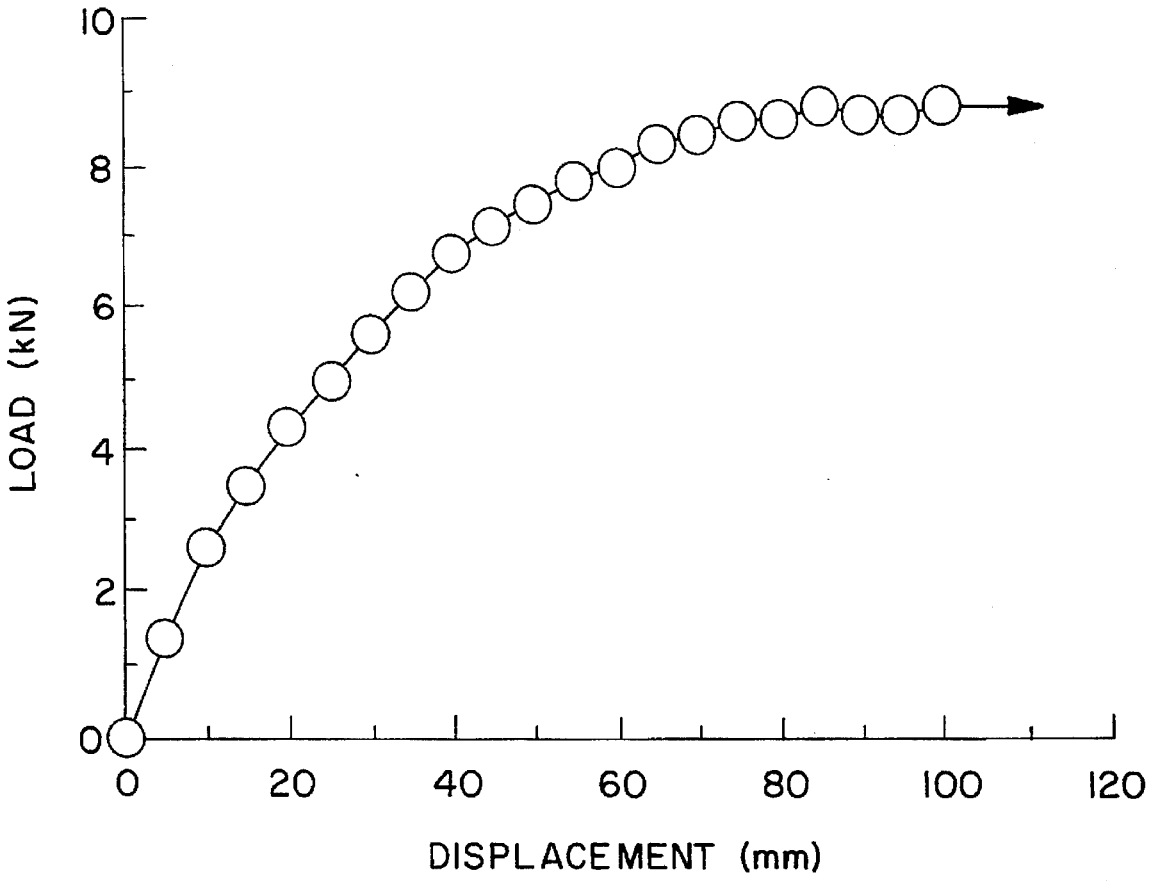
FIG. 23 is a graph illustrating the results of the above-described experiment.

As is shown in FIG. 22, two frames 20 formed by stamping molding of FRTP and each having a size of about 1.2 m×1.05 m are connected to each other at points a as is described above. While the assembly of the two frames 20 were supported at four corners thereof, a load b was applied to the points a. The displacement of the points a in accordance with the load b is shown in FIG. 23.

When the load b is relatively small, the displacement at the points a is small, whereas when the load b is relatively large, the displacement is large with respect to the change in the load b. In other words, the floating pier 100 formed of FRTP moves only slightly even when someone walks thereon, but moves significantly upward and downward in correspondence with the vertical movement of the waves. When being subjected to a strong impact of waves, the floating pier 100 flexibly moves. Accordingly, the floating pier 100 is strong against destruction.

EXAMPLE 2

Figure 26:
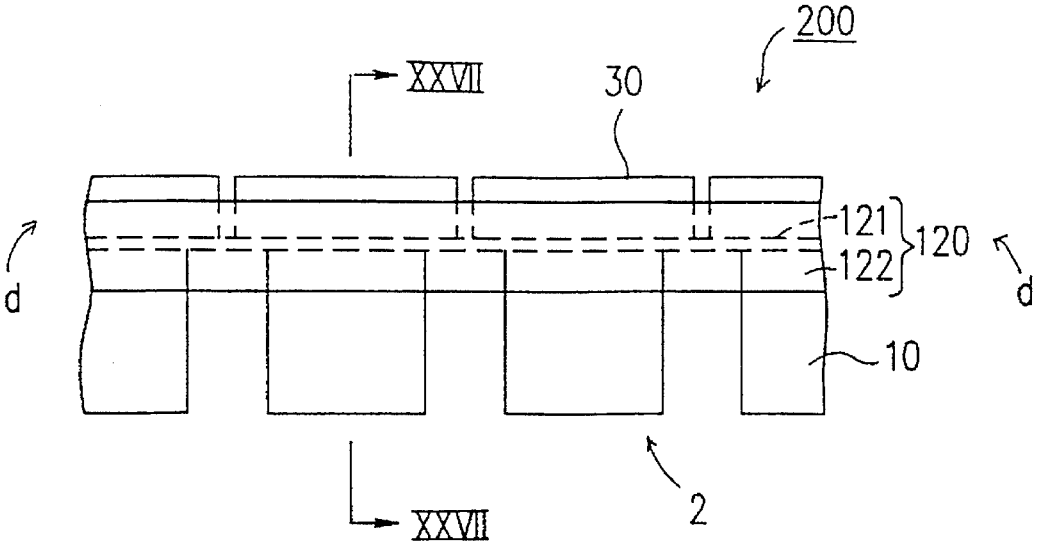
FIG. 26 is a partial side view of a floating pier in another example according to the present invention.
Figure 27:
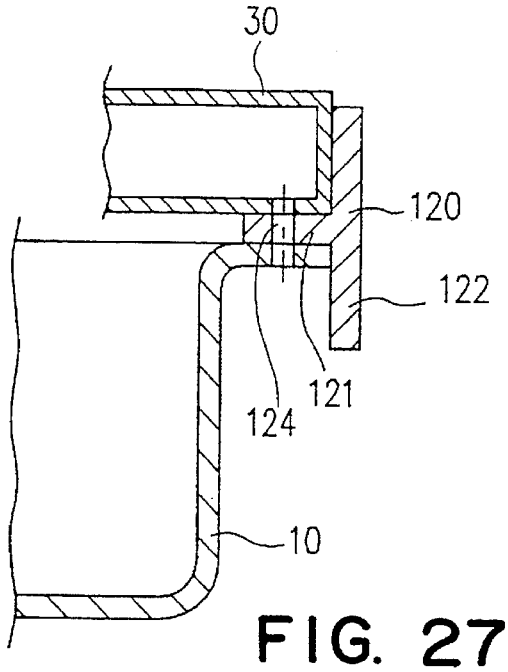
FIG. 27 is a cross sectional view along lines XXVII—XXVII in FIG. 26, illustrating the connection of the deck, the frame and the float of the pier unit shown in FIG. 26.

A floating pier 200 including a plurality of pier units 2 in a second example according to the present invention will be described. FIG. 26 is a front view of a floating pier 200, and FIG. 27 is a cross sectional view of the floating pier 200 taken along lines XXVII—XXVII in FIG. 26.

The pier unit 2 includes a T-shaped frame 120, a deck 30 provided on the frame 120, and a float 10 provided below the frame 120.

The frame 120 includes a connecting portion 121 and a vertical piece 122 which are integrally formed so that the vertical piece 122 is at a center level of the connecting portion 121 in the vertical direction. The deck 30 and the float 10 are respectively secured on a top surface and a bottom surface of the connecting portion 121 by a bolt and a nut inserted through a through-hole 124 formed in the connecting portion 121. The deck 30 and the float 10 can also be secured by use of a screw, welding and the like instead of a bolt and a nut.

Figure 29:
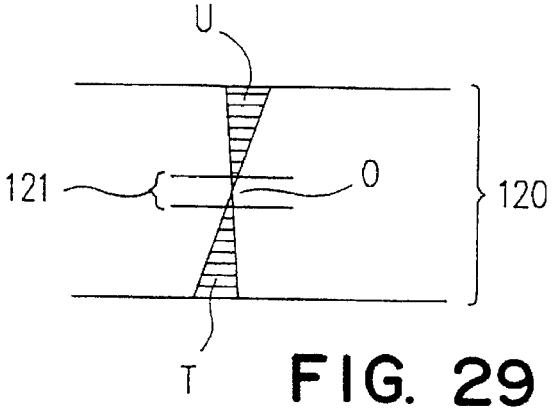
FIG. 29 is a view illustrating the distribution of the strain in the floating pier shown in FIGS. 27 and 28.

In the pier unit 2 in the second example, even if the strain is distributed as is shown by letters T and U in FIG. 29 in the entire area of the frame 120, the stress applied to the connecting portion 121 is small as is indicated by an area in the vicinity of point O, at which no strain is generated. That is, even if a large external force d is applied to the frame 120, the deck 30 and the float 10 connected to the connecting portion 121 are subjected to only a small stress. Accordingly, the deck 30 and the float 10 are difficult to be destroyed.

Figure 28:
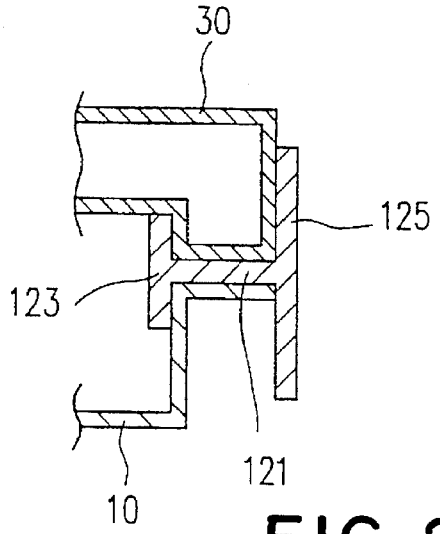
FIG. 28 is a cross sectional view, illustrating the connection of the deck, the frame and the float of the pier unit in a modification of the example shown in FIG. 26.

As is shown in FIG. 28, the frame can have an inner vertical portion 123 and an outer vertical portion 125 integrally formed at two peripheral edges of the connecting portion 121 instead of being T-shaped.

EXAMPLE 3

Figure 30A:
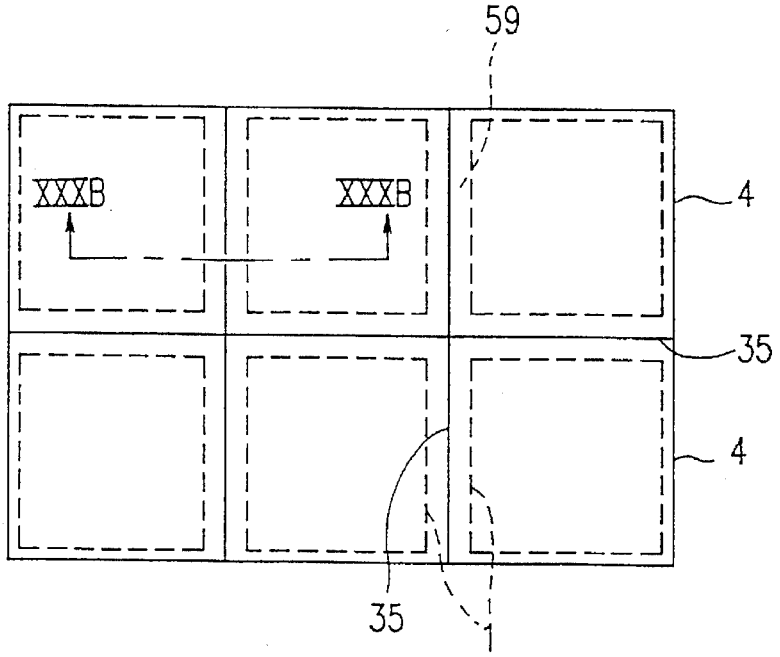
FIG. 30A is a plan view of a floating pier in still another example according to the present invention.
Figure 30B:
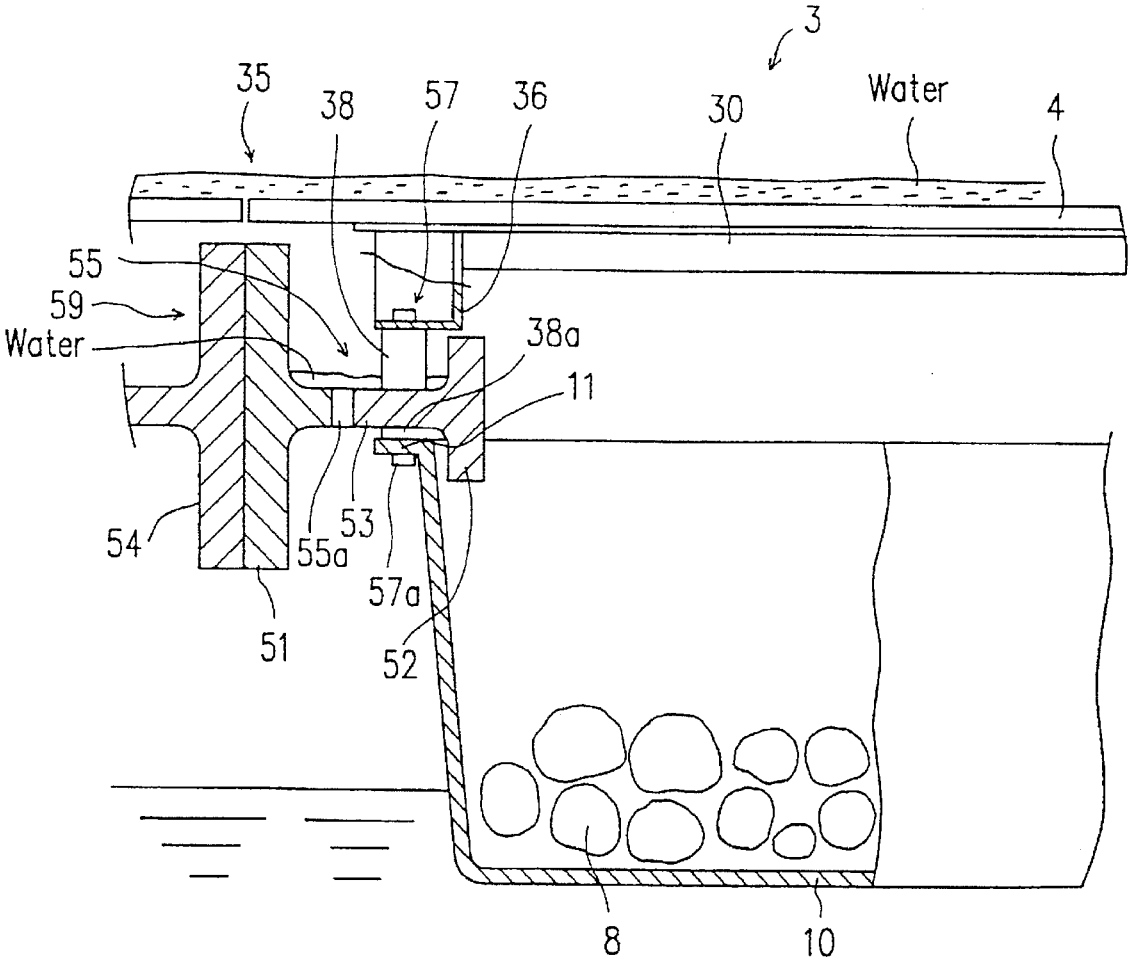
FIG. 30B is a cross sectional view of the floating pier along lines XXXB—XXXB in FIG. 30A, illustrating a connection part of the deck, the frame and the float.
Figure 31A:
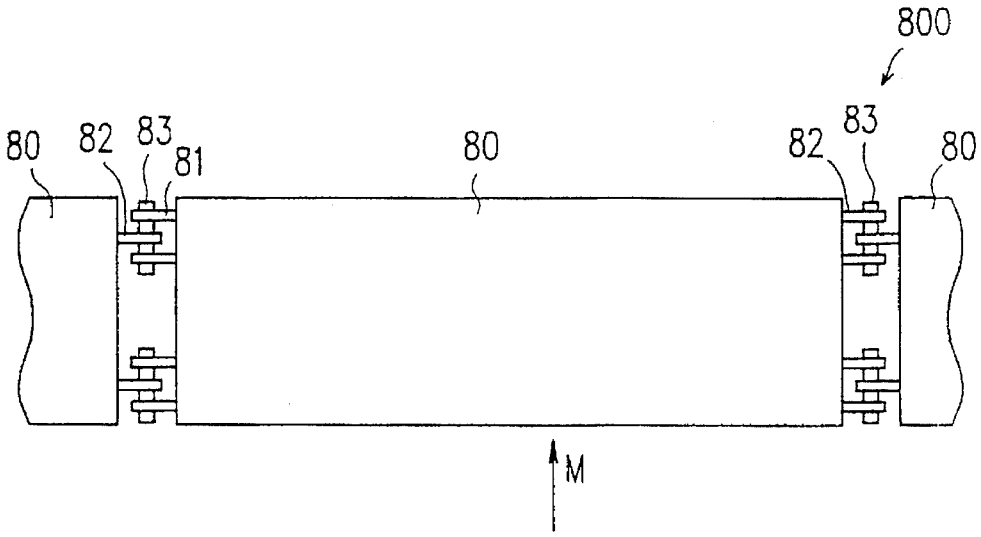
FIG. 31A is a plan view of a conventional floating pier.
Figure 31B:
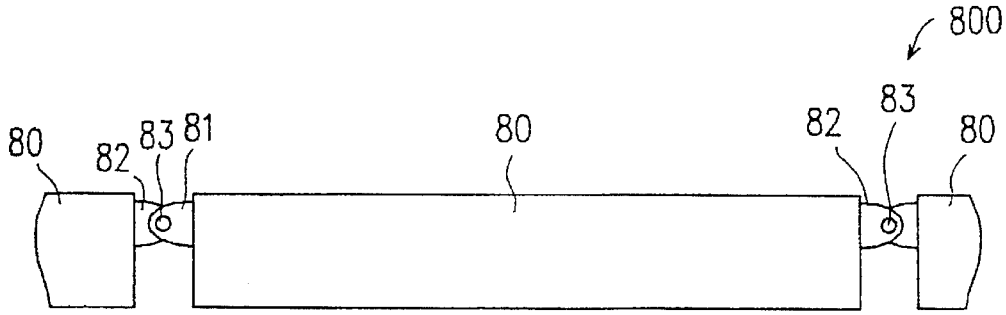
FIG. 31B is a side view thereof in the direction of arrow M.
Figure 32:
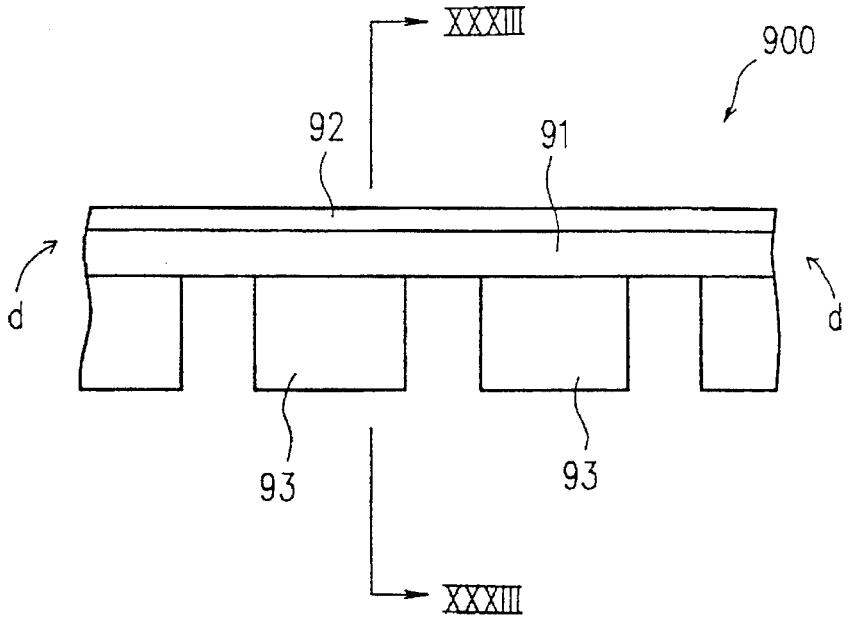
FIG. 32 is a side view of another conventional floating pier including a plurality of pier units.
Figure 33:
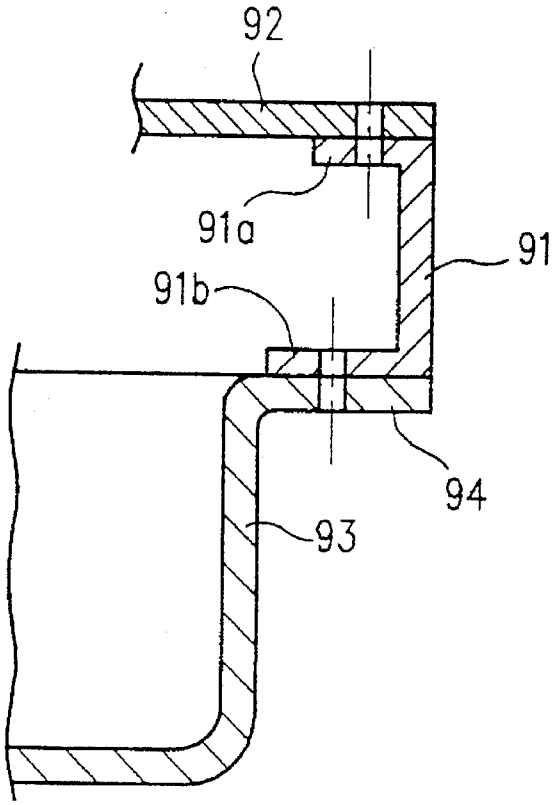
FIG. 33 is a cross sectional view along lines XXXIII—XXXIII in FIG. 32, illustrating connection of the deck, the frame and the float of the pier units.
Figure 34:
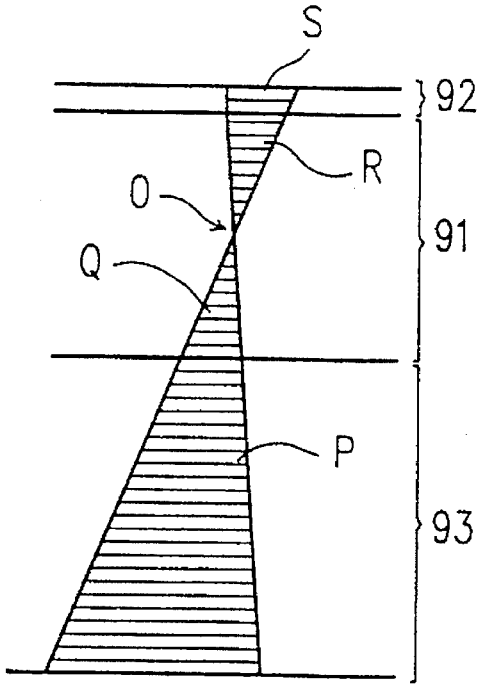
FIG. 34 is a view illustrating the strain distribution of the pier unit shown In FIGS. 32 and 33.
Figure 35A:
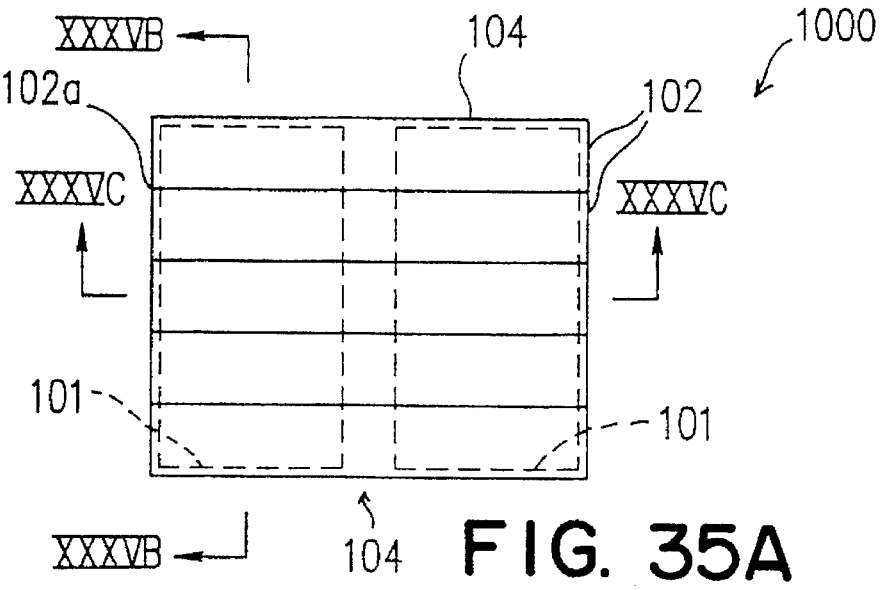
FIG. 35A is a plan view of still another conventional floating pier.
Figure 35B:
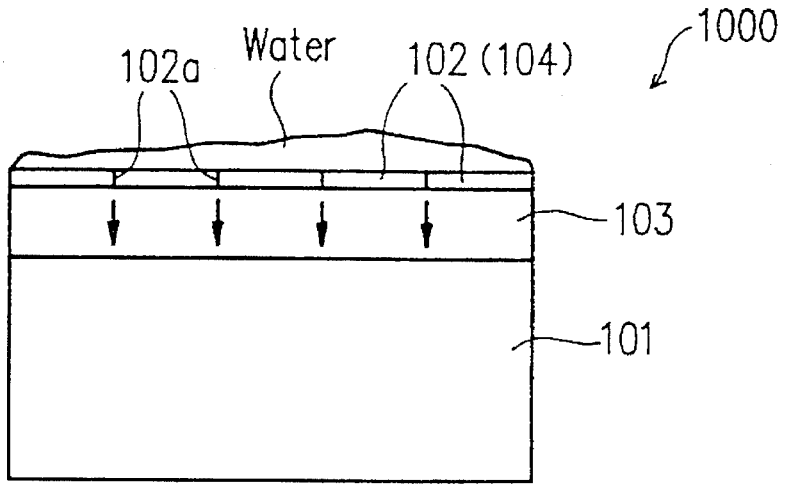
FIG. 35B is a cross sectional view thereof taken along lines XXXVB—XXXVB in FIG. 35A.
Figure 35C:
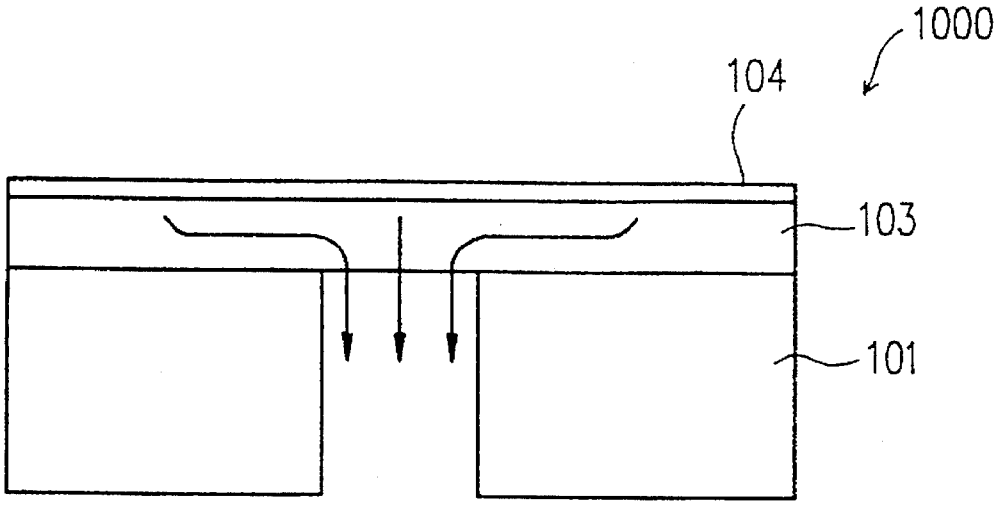
FIG. 35C is a cross sectional view thereof taken along lines XXXVC—XXXVC in FIG. 35A.
Figure 36:
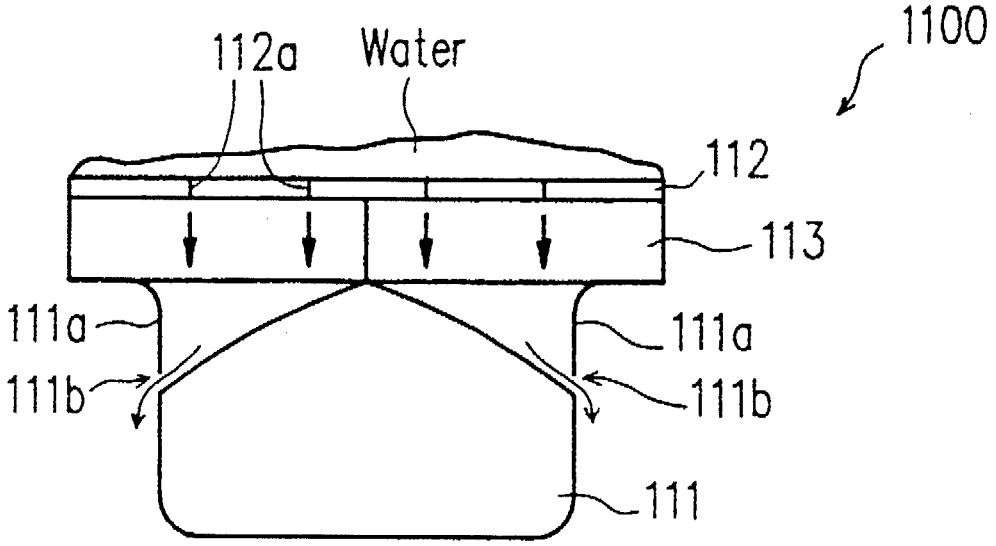
FIG. 36 is a side view of still another conventional floating pier.

A floating pier including a plurality of pier units 3 in a Third example according to the present invention will be described. FIG. 30A is a plan view of the pier unit 3, and FIG. 30B is a cross sectional view of a part at which two adjacent pier units 3 are connected to each other.

Two pier units 3 are connected by a reinforcing member 59 having two frames 54 each having a substantially H-shaped vertical cross section. The pier unit 3 includes the frame 54, a deck 30 supported by the frame 54, and a surface board 4 provided on the deck 30, and a float 10 secured to a bottom part of the frame 54. The float 10 supplies the pier unit 3 with a buoyancy.

The frame 54 includes an outer vertical portion 51, an inner vertical portion 52, and a connecting portion 53. Outer surfaces of two outer vertical portions 51 are bonded to form the reinforcing member 59. The outer vertical portion 51, the inner vertical portion 52, and the connecting portion 53 define a gutter 55.

The outer vertical portion 51 is disposed below a gap 35 between the two adjacent surface boards 4, and the inner vertical portion 52 is disposed inside an outer edge of the surface board 4. Water flowing on the floating pier drops onto the gutter 55 through the gap 35.

The frame 54, the float 10 having a flange 11, and the deck 30 are connected in the following manner.

The connecting portion 53 of the frame 54 is placed on the flange 11 of the float 10 through a packing 38*a* interposed therebetween. A tap block 38 which is internally threaded at a top portion and a bottom portion thereof is placed on the connecting portion 53. A securing portion 36 of the deck 30 is positioned on the tap block 38. A screw 57 is tightened into the tap block 38 to secure the deck 30 to the frame 54. Another screw 57*a* is inserted into the flange 11, the packing 38*a* and a through-hole of the connecting portion 53 to be screwed into the tap block 38. Thus, the float 10 is secured to the frame 54.

The outer diameter of the tap block 38 is larger than the diameter of the through-hole of the connecting portion 53 to prevent water from dropping through the through-hole.

The tap block 38 is closer to the inner vertical portion 52 than to the outer vertical portion 51, and the gutter 55 has a through-hole 55*a* for water drainage closer to the outer vertical portion 51 than to the inner vertical portion 52.

The through-hole 55*a* for water drainage is preferably formed at such a position as to prevent water from running along the reinforcing member 59 and a top part of the float 10. An appropriate number of through-holes 55*a* having an appropriate size are formed so as to avoid water overflowing from the gutter 55, in consideration of the cross sectional area of the gutter 55. The deck 30 and the float 10 can be secured to the frame 54 by bonding or welding in addition to use of a screw.

In the floating pier having the above-described structure, water on the surface boards 4 drops onto the gutter 55 through the gap 35 and flows along a certain path along the gutter 55. Even if the float 10 has an opening at the top, the water does not enter the float 10. Accordingly, the float 10 can have a simple structure without a roof or a through-hole. Since the float 10 can have an opening at the top, ballast 8 for adjusting the center of gravity can be put in the float 10 by detaching the surface boards 4.

The water received by the gutter 55 drops onto the surface of the sea below through the through-hole 55*a*. By appropriately positioning the through-hole 55*a* as is described above, the water also runs along a certain path.

In the third example, the frame 20 has a substantially H-shaped vertical cross section. The frame 20 can also have a substantially C-shaped vertical cross section. Instead of providing a gutter defined by a part of the frame 20, a separate gutter can be provided to the frame 20. The outer surfaces of the outer vertical portions 51 can be fixed together by welding or the like. Instead of bonding the outer vertical portions 51, the pier units 3 can be connected at a corner thereof using a connecting piece, and a bolt and a nut as is described in the first example.

In the above description, the floating pier is used on the sea, but a floating pier according to the present invention can also be used in any type of body of water such as a lake.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A pier unit, comprising:

a float having substantially a box shape with an opening at the top and including a flange extending outward along a top peripheral edge thereof;

a rectangular frame attached to the float;

a deck provided on the frame;

a connecting member secured to at least one of four corners of the frame for connecting the pier unit to another pier unit, and a fender provided on an outer surface of the frame, wherein the frame includes a connecting portion, a vertical portion extending from an outer peripheral edge of the connecting portion, and an inner vertical portion extending from an inner peripheral edge of the connecting portion, the connecting portion is, in a vertical direction, at a substantially central level of the outer vertical portion, the deck is secured to a top surface of the connecting portion, and the float is secured to a bottom surface of the connecting portion, the inner vertical portion is located inside the flange of the float, and the outer vertical portion is located outside the flange of the float; the connecting portion, the inner vertical portion, and the outer vertical portion form a gutter, and the fender is attached to an outer surface of the outer vertical portion.

2. A pier unit according to claim 1, wherein the connecting portion of the frame has a through-hole for allowing water in the gutter to drop to a surface of water below the pier unit.

3. A pier unit according to claim 1, wherein the float has ballast accommodating portions at four corners thereof, and contains a foam resin in an area excluding the ballast accommodating portions.

4. A pier unit according to claim 1, wherein the frame is attached to the flange of the float in a watertight manner with a packing interposed therebetween, and the deck is attached to the frame in a watertight manner with another packing interposed therebetween.

5. A pier unit according to claim 1, further comprising surface board provided on the deck for improving the appearance of the pier unit.

6. A pier unit according to claim 1, wherein at least one of the frame, the deck and the float is formed of a fiber reinforced thermoplastic resin.

7. A floating pier comprising a plurality of pier units, each pier unit including:

a float having substantially a box shape with an opening at the top and including a flange extending outward along a top peripheral edge thereof;

a rectangular frame attached to the float;

a deck provided on the frame; and a connecting member secured to at least one of four corners of the frame for connecting the pier unit to another pier unit, wherein:

the frame of each pier unit includes a connecting portion, an upper portion extending upward from an outer peripheral edge of the connecting portion, and a lower portion extending downward from the outer peripheral edge of the connecting portion, the connecting member of each pier unit has a taper surface and is provided on a top surface of the connecting portion so as to be flush against the upper portion, and another reconnecting member having a taper surface is provided on a bottom surface of the connecting portion so as to be flush against the lower portion, the floating pier further includes a connecting piece having an inclined portion and covering the upper connecting members of the plurality of pier units, a connecting piece having an inclined portion and covering the lower connecting members of the plurality of pier units and further having a guide member extending from a bottom surface thereof, and a tap place provided below the lower connecting piece, and the plurality of pier units are connected to each other by tightening a bolt inserted into the upper connecting piece, the lower connecting piece and the tap plate to pressure-contact the inclined portions of the connecting pieces on the taper surfaces of the connecting members, while the tap plate is prevented from rotating by the guide member thereof.

8. A floating pier comprising a plurality of substantially rectangular pier units connected to each other, the floating pier including:

a connecting portion extending from a side surface of each pier unit;

an upper portion extending upward from an outer peripheral edge of the connecting portion;

a lower portion extending downward from the outer peripheral edge of the connecting portion;

a connecting member having a taper surface and provided on a top surface of the connecting portion so as to be flush against the upper portion;

another connecting member having a taper surface and provided on a bottom surface of the connecting portion so as to be flush against the lower portion;

a connecting piece having an inclined portion and covering the upper connecting members of the plurality of pier units;

another connecting piece having an inclined portion and covering the lower connecting members of the plurality of pier units and further having a guide member extending from a bottom surface thereof; and a tap plate provided below the lower connecting piece, wherein the plurality of pier units are connected to each other by tightening a bolt inserted into the upper connecting piece, the lower connecting piece and the tap plate to pressure-contact the inclined portions of the connecting pieces on the taper surfaces of the connecting members, while the tap plate is prevented from rotating by the guide member thereof.

* * * * *